US007306221B2

(12) United States Patent
Agata

(10) Patent No.: US 7,306,221 B2
(45) Date of Patent: Dec. 11, 2007

(54) SHEET CONVEYING APPARATUS AND IMAGE FORMING APPARATUS

(75) Inventor: Jun Agata, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 365 days.

(21) Appl. No.: 11/113,024

(22) Filed: Apr. 25, 2005

(65) Prior Publication Data

US 2005/0242493 A1 Nov. 3, 2005

(30) Foreign Application Priority Data

Apr. 28, 2004 (JP) ..... 2004-132959

(51) Int. Cl.
*B65H 9/16* (2006.01)

(52) U.S. Cl. ..... 271/251; 271/250; 271/252

(58) Field of Classification Search ..... 271/226, 271/250, 251, 252
See application file for complete search history.

(56) References Cited

U.S. PATENT DOCUMENTS

| | | | | |
|---|---|---|---|---|
| 4,334,759 | A * | 6/1982 | Clausing | 399/394 |
| 5,162,857 | A * | 11/1992 | Higeta et al. | 399/401 |
| 6,019,365 | A * | 2/2000 | Matsumura | 271/227 |
| 6,273,418 | B1 * | 8/2001 | Fujikura et al. | 271/228 |
| 6,886,828 | B2 * | 5/2005 | Saito | 271/225 |
| 6,952,556 | B2 | 10/2005 | Endo et al. | 399/390 |
| 2003/0075860 | A1 * | 4/2003 | Hashiguchi et al. | 271/250 |
| 2005/0201791 | A1 | 9/2005 | Endo et al. | 399/390 |
| 2005/0218586 | A1 | 10/2005 | Agata | 271/226 |

FOREIGN PATENT DOCUMENTS

| | | |
|---|---|---|
| JP | 1-53886 | 3/1989 |

* cited by examiner

*Primary Examiner*—Patrick Mackey
*Assistant Examiner*—Howard Sanders
(74) *Attorney, Agent, or Firm*—Fitzpatrick, Cella, Harper & Scinto

(57) ABSTRACT

A sheet conveying apparatus with a skew feed correcting device including a first guide supporting one side edge of the sheet, an aligning device provided in the first guide and having an abutment portion and a first roller pair for causing the sheet to abut the abutment portion, a contact-separation device for separating and contacting the first roller pair, a second guide supporting the other side edge of the sheet, a positioning device for moving the first guide in a direction substantially perpendicular to a sheet conveying direction, a second roller pair downstream of the first and second guides, a slide device for moving the second roller pair in the direction, and a sheet detector. When conveying the sheet, the positioning device moves the first guide such that the abutment portion is at a predetermined distance from the side edge of the sheet, the sheet is conveyed while aligned by abutted against the abutment portion by the first roller pair, the first roller pair is separated by the contact-separation device based on the detection of the sheet detector, and the sheet is moved by the slide device so as to be returned by the predetermined distance while held by the second roller pair.

8 Claims, 18 Drawing Sheets

SENSOR OFF

SENSOR OFF

SENSOR ON

SENSOR ON

SENSOR ON

SENSOR ON

SHEET CONVEYING APPARATUS AND IMAGE FORMING APPARATUS

BACKGROUND OF THE INVENTION

1. Field of the Invention

The present invention relates to an image forming apparatus, such as a printer or a copying machine, and, in particular, to a sheet conveying apparatus equipped with a skew feed correcting device for correcting skew feed of a sheet.

2. Related Background Art

Generally, an image forming apparatus, such as a printer or a copying machine, is equipped with a sheet conveying apparatus for conveying a sheet as a transfer material. In the sheet conveying apparatus, a phenomenon called skew feed may occur during conveyance due to misalignment of the conveying roller, distortion of a sheet guide, etc. that are attributable to inadequacy in the assembly precision of the components. If image formation is conducted with skew feed neglected, the resultant image is naturally distorted with respect to the sheet. In particular, in an image forming apparatus with a two-side printing function, there may be involved a marked deviation between the transfer image on the first side and the transfer image on the second side.

In view of this, many image forming apparatuses are equipped with a skew feed correcting device for correcting skew feed of a sheet. The known skew feed correcting devices may be roughly classified into two types.

First, a sheet correction system utilizing registration rollers as a reference as disclosed, for example, in JP H01-053886 A, will be described. A pair of registration rollers are arranged so as to extend in a direction substantially perpendicular to the sheet conveying direction. On the upstream side of the registration roller pair, there is arranged a blocked sheet guide. A sheet is caused to abut the registration roller pair, with the rotation of the registration rollers at rest, and the conveyance of the sheet is continued, whereby a loop is formed in the sheet. As a result, the leading edge of the sheet is in conformity with the nip line of the registration rollers, thus making it possible to correct skew feed.

Then, the registration roller pair conveys the sheet toward a transfer means in synchronism with a toner image formed by an image forming means. That is, in this conventional construction, the registration roller pair effects positioning on the sheet with respect to the two directions of the sheet rotating direction (skew feed) and the sheet conveying direction.

Next, a side-registration-type skew feed correcting device as disclosed, for example, in JP H11-189355 A, will be described. In a part of a blocked sheet guide, there are provided a reference wall parallel to the sheet conveying direction and a diagonal feed roller whose rotating surface is inclined toward the reference wall. Sheet conveyance is effected while causing a sheet side edge portion to move along the reference wall, whereby skew feed correction is effected.

The system utilizing the registration rollers as a reference is adopted in many image forming apparatuses of the type which use the sheet center as a reference and in which the sheet conveyance is divided in the middle portion of the conveying path, whereas the side-registration-type skew feed correction system is adopted in many image forming apparatuses of the sheet-side reference type, in which a reference is provided on one side of the apparatus and in which a side edge portion of a sheet is aligned with this reference.

The above-described conventional skew feed correcting devices, however, have the following problems.

First, the problem in the registration-roller-type skew feed correcting device will be discussed. This skew feed correcting device, which corrects skew feed by using the sheet leading edge as a reference, is capable of correcting skew feed of the trailing edge of a sheet, but is incapable of correcting deviation in the sheet width direction (the direction orthogonal to the conveying direction). Further, since the sheet is caused to abut the registration roller pair, it is necessary to effect temporary stopping, which makes it difficult to achieve an improvement in productivity. Further, when effecting correction on a thick-fore-edge sheet, such as the cover of a booklet, it may occur that a loop cannot be formed due to the high rigidity of the sheet. Further, in some cases, the sheet may penetrate the nip of the registration rollers, thus making it impossible to perform the alignment itself. Further, in an image forming apparatus with a two-side printing function, when effecting switch-back reversal on the sheet, the leading edge of the first surface is replaced by that of the second surface, so that a deviation in parallelism between the leading and trailing edges of the sheet manifests itself as an image deviation.

Next, the problem in the side-registration-type skew feed correcting device will be discussed. As is characteristic of a sheet-side-reference type conveying system, the sheet holding position is deviated to the side-reference side with respect to the center of the conveying path (sheet side reference). Normally, the conveying roller is rotatably supported by a side plate through the intermediation of bearings, and receives a pressure for holding and conveyance from an opposing pressurizing roller. When the pressure is applied from the pressurizing roller to the conveying roller, deflection is generated in the conveying roller, and the pressure tends to be relatively high at the ends of the conveying roller and relatively low in the middle portion thereof. Thus, in a sheet-side-reference type conveying system, the holding pressure is relatively high on one side of the sheet (an end portion of the conveying path), and relatively low on the other side thereof (the side near the center of the conveying path). A high holding pressure results in an increase in conveying speed, which leads to skew feed.

Further, due to the irregularity in holding pressure, the roller undergoes uneven wear, which is also liable to cause skew feed in the conveying path. In particular, when the uneven wear progresses as a result of long-term use, it is to be expected that, sooner or later, the skew feed amount will increase beyond the permissible amount for the skew feed correcting device. On the other hand, provision of a pressure adjustment mechanism for making the holding pressure in the width direction of the conveying roller uniform would complicate the device construction and adjusting operation and lead to an increase in production cost, which is not desirable.

SUMMARY OF THE INVENTION

It is accordingly an object of the present invention to provide a sheet conveying apparatus for an image forming apparatus of the type in which sheet conveyance is effected by using the sheet center as a reference, wherein the sheet conveying apparatus is capable of effecting side-registration-type skew feed correction.

To attain the above object, according to the present invention, there is provided a sheet conveying apparatus including a skew feed correcting device for correcting skew feed of a sheet conveyed using a sheet center as a reference, the skew feed correcting device including: a first conveying guide supporting one side edge portion of the sheet; an aligning means provided in the first conveying guide and having an abutment portion against which a side edge portion of the sheet is brought into abutment and a first rotary roller pair which conveys the sheet to abut the abutment portion; a contact-separation means which causes the first rotary roller pair to effect separation or contact; a second conveying guide supporting the other side edge portion of the sheet; a positioning means for moving the first conveying guide in a direction substantially perpendicular to a sheet conveying direction; a second rotary roller pair arranged on the downstream side of the first conveying guide and the second conveying guide with respect to the sheet conveying direction; a slide means for moving the second rotary roller pair in a direction substantially perpendicular to the sheet conveying direction; and a sheet detecting means arranged in the vicinity of the second rotary roller pair, in which, when conveying the sheet, the positioning means moves the first conveying guide such that the abutment portion is located at a predetermined distance from the side edge portion of the sheet that is conveyed normally by using the center thereof as a reference, the sheet is conveyed while aligned by being caused to abut the abutment portion by the first rotary roller pair, the first rotary roller pair is separated by the contact-separation means based on detection of the sheet by the sheet detecting means, and the second rotary roller pair is moved by the slide means so as to return at the predetermined distance.

BRIEF DESCRIPTION OF THE DRAWINGS

FIGS. 7A through 7F are diagrams illustrating the operation of the roller pressurization unit, of which FIGS. 7A and 7B are diagrams showing a pressure-released state, FIGS. 7C and 7D are diagrams showing a standby state, and FIGS. 7E and 7F are diagrams showing a pressurizing state;

DESCRIPTION OF THE PREFERRED EMBODIMENTS

A skew feed correcting device according to the present invention and an image forming apparatus equipped with the same will be described by way of example. The description will be given in the following order: the general construction of the image forming apparatus, the construction of the skew feed correcting device, and the characteristic operation of this embodiment.

{General Construction of the Image Forming Apparatus}

Figure 1:
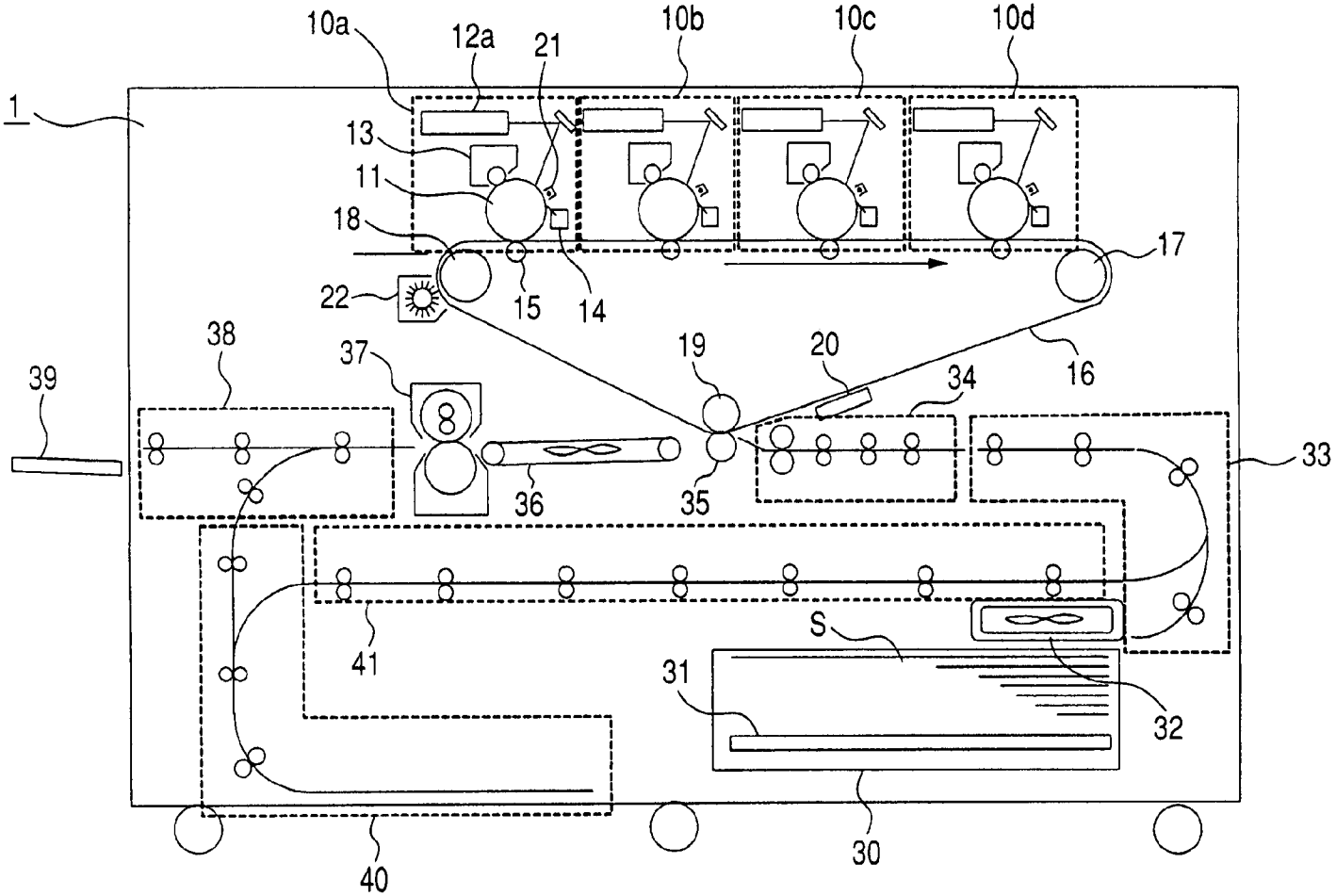
FIG. 1 is a sectional view schematically showing the construction of an image forming apparatus.

The general construction of the image forming apparatus will be described with reference to FIG. 1. FIG. 1 is a sectional view schematically showing the construction of the image forming apparatus of this embodiment.

FIG. 1 shows an image forming apparatus 1 that consists of a color printer using an electrophotographic process, which is equipped with a registration portion 34 described below as an example of the skew feed correcting device. In the image forming apparatus 1, image forming portions 10*a* through 10*d* for forming images of the colors of yellow, magenta, cyan, and black are arranged in parallel.

All the image forming portions 10*a* through 10*d* are of the same construction, so that the internal construction of only the image forming apparatus 10*a* will be described. A photosensitive drum 11 constituting an image bearing member is rotated, and its surface is uniformly charged by a charging means 21. Thereafter, scanning is effected with a laser beam from a laser scanner unit 12 to form an electrostatic latent image on the photosensitive drum. Further, the electrostatic latent image is visualized as a toner image by a developing unit 13 accommodating developer of each color (hereinafter referred to as the toner). The toner image on the photosensitive drum 11 is transferred to an intermediate transfer belt 16 by a bias applied to a primary transferring roller 15. On the downstream side of the primary transfer position of the photosensitive drum 11, there is arranged a drum cleaning device 14, which cleans the surface of the photosensitive drum 11 by removing residual toner therefrom. By the above process, toner images of the different colors are successively transferred to the intermediate transfer belt 16 so as to be superimposed one upon the other.

The intermediate transfer belt 16 is stretched around a tension roller 17, a driving roller 18, and an inner secondary transferring roller 19. The tension roller 17 imparts a predetermined tension to the intermediate transfer belt 16, which is driven in the direction indicated by the arrow in FIG. 1 by the driving roller 18. Further, in the vicinity of the intermediate transfer belt 16, there is arranged a toner patch reading means 20 for reading a density measurement patch.

Sheets S accommodated in a feeding unit 30 are retained at a predetermined feeding position by a lifter plate 31, and are fed one by one by a feeding/separation unit 32. The feeding/separation unit 32 performs feeding by supplying sheets S sucked up by a suction fan to the downstream side by a conveying belt. In a feeding/conveying unit 33, temporary stop is effected in order to absorb variation in conveyance in the feeding/separation unit 32 and the feeding/conveying unit 33, and then the sheets are delivered to the registration portion 34. The registration portion 34 corrects skew feed of a sheet by the construction and operation as described below, regulates the sheet position in the width direction, and further, conveys the sheet to a secondary transfer portion while keeping the sheet position in the conveying direction in synchronism with the image on the intermediate transfer belt 16.

In the secondary transfer portion, a bias is applied to an outer secondary transferring roller 35 as an example of the transfer means, and the toner image on the intermediate transfer belt 16 is transferred to the sheet S. Further, the sheet S is conveyed to a fixing unit 37 by a pre-fixing conveying unit 36, and the toner image is fixed to the sheet S. Any toner, extraneous additive, etc. remaining on the intermediate transfer belt 16 after the secondary transfer are removed by a cleaning device 22.

In the case of a one-side printing process, the sheet S is conveyed by a discharging unit 38, and discharged onto a discharging tray 39. In the case of a two-side printing process, the sheet S is conveyed to a reversal unit 40, and, after being reversed, is conveyed to the feeding/conveying unit 33 and the registration portion 34 by way of a duplex transport unit 41. After an image has been transferred and fixed to the rear surface thereof, the sheet is discharged onto the discharging tray 39.

{Construction of the Skew Feed Correcting Device}

Figure 2:
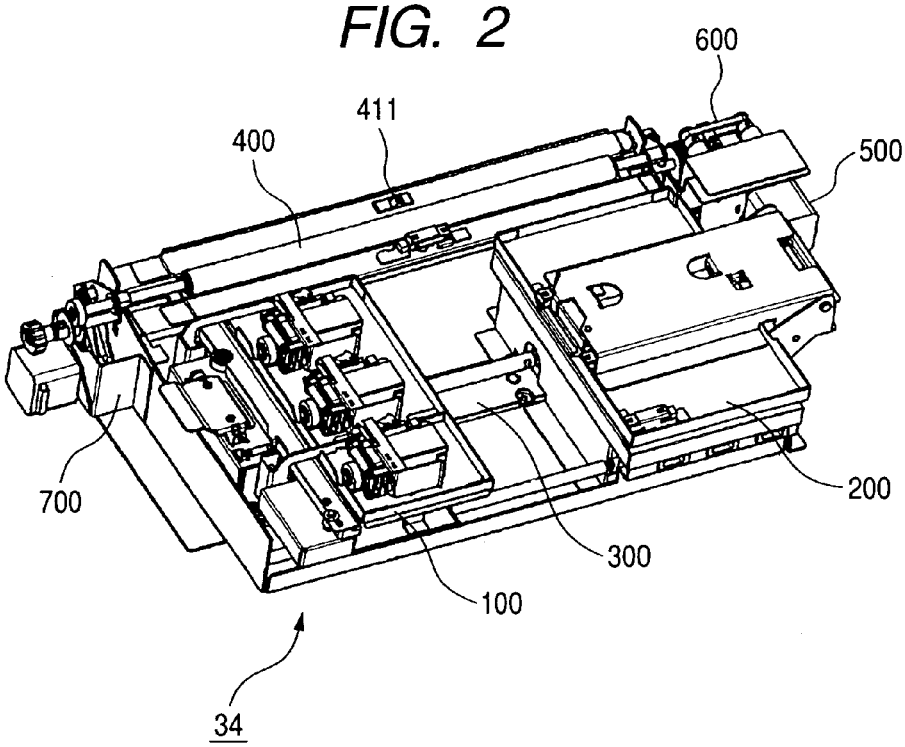
FIG. 2 is a perspective view showing the general construction of a registration portion.

The construction of the registration portion 34 serving as the skew feed correcting device will be schematically described. FIG. 2 is a perspective view showing the general construction of the registration portion, and FIG. 3 is a perspective view showing the condition of the registration portion during jam processing.

As shown in FIG. 2, the registration portion 34 is equipped with a diagonal feed roller guide portion 100 as an example of a first conveying guide supporting one side edge portion of the sheet and forming a conveying path, and a stationary guide portion 200 as an example of a second conveying guide supporting the other side edge portion of the sheet and forming a conveying path. The diagonal feed roller guide portion 100 can undergo movement and positioning in the sheet width direction (a direction substantially orthogonal to the sheet conveying direction) by a diagonal feed guide jogging portion 300 as an example of a positioning means. Further, on the downstream side with respect to the sheet conveying direction of the diagonal feed roller guide portion 100 and the stationary guide portion 200, there are provided a registration roller portion 400 as an example of the second rotary roller pair, a registration roller driver portion 500, a registration roller slider portion 600 as an example of a slide means for moving the registration roller portion 400 in the sheet width direction, and a registration roll pressure releasing portion 700. On the downstream side of the diagonal feed roller guide portion 100 with respect to the sheet conveying direction, there is provided a sheet detecting sensor 411 as an example of a sheet detecting means.

Figure 3:
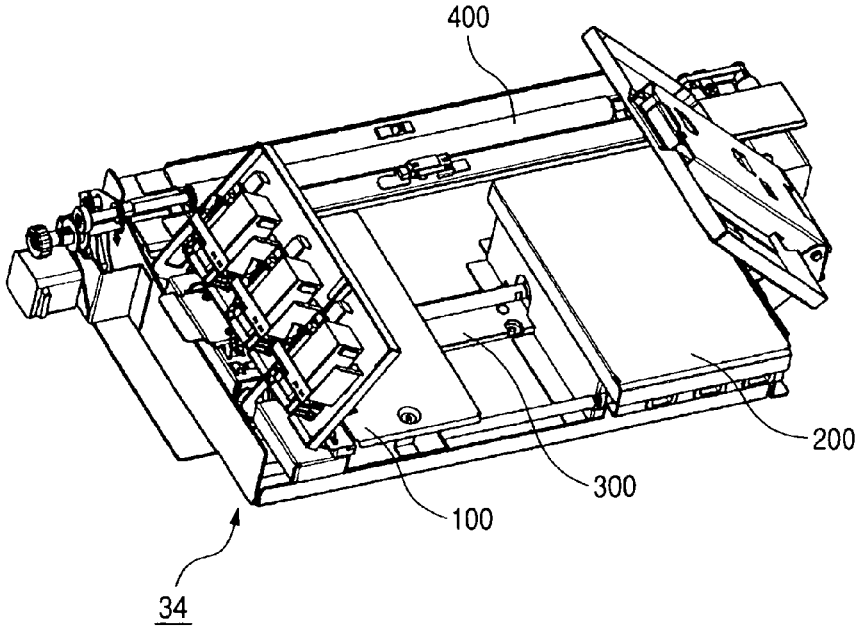
FIG. 3 is a perspective view of the condition of the registration portion during jam processing.

Further, as shown in FIG. 3, the diagonal roller guide portion 100 and the stationary guide portion 200 are constructed so as to be capable of opening and closing. This makes it possible to open up the internal sheet conveying path and to remove a jammed sheet. In the following, the construction and operation of each component will be described in detail.

<Diagonal Feed Roller Guide Portion 100>

Figure 4:
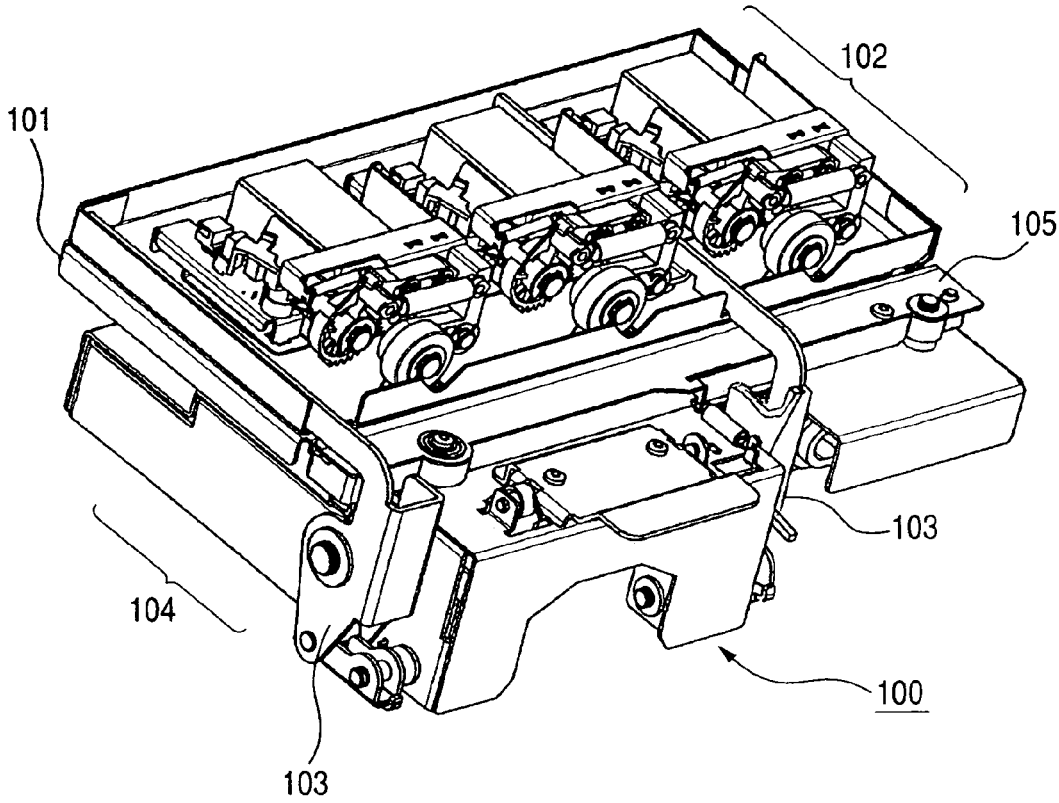
FIG. 4 is a perspective view illustrating the construction of a diagonal feed roller guide portion.

FIG. 4 is a perspective view illustrating the construction of the diagonal feed roller guide portion. As shown in FIG. 4, the diagonal feed roller guide portion 100 is further composed of a lower guide portion 101, an upper guide portion 102, a hinge portion 103, a base portion 104, and a rectifying plate 105 as an example of an abutment portion. In this embodiment, as an example of the first rotary roller pair, there are provided three diagonal feed rollers 111 and three diagonal feed runners 121.

(Lower Guide Portion 101)

Figure 5A:
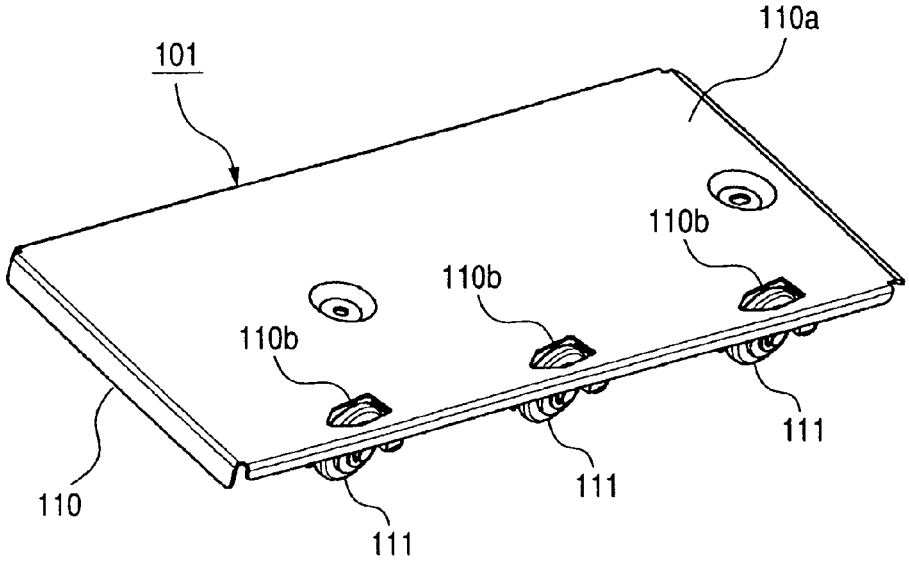
FIG. 5A is a perspective view as seen from above of a lower guide portion.
Figure 5B:
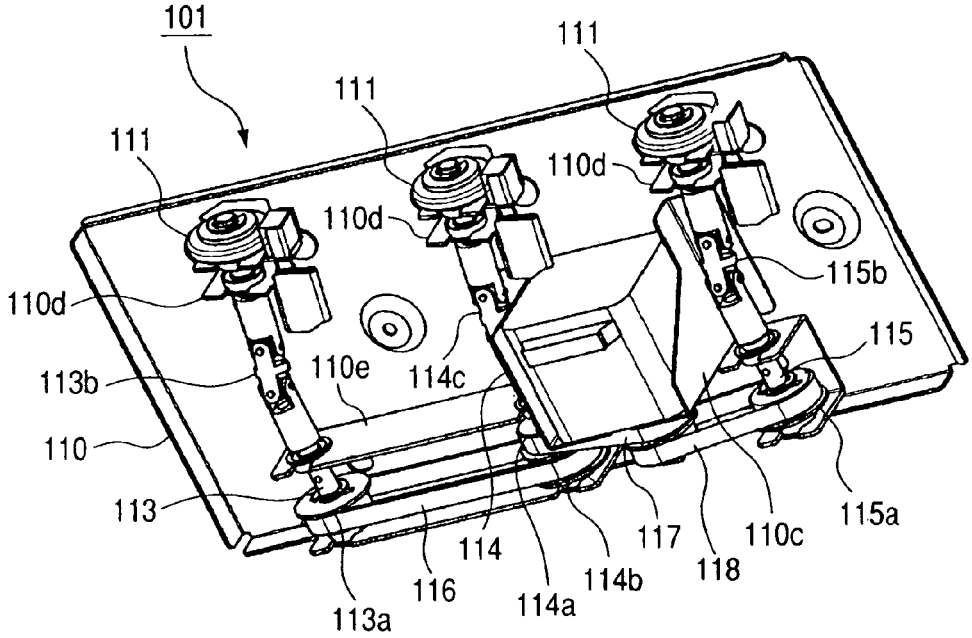
FIG. 5B is a perspective view as seen from below of the lower guide portion.

FIGS. 5A and 5B are diagrams illustrating the lower guide portion. FIG. 5A is a perspective view as seen from above, and FIG. 5B is a perspective view as seen from below. As shown in FIG. 5A, in the lower guide portion 101, the upper surface of the guide plate 110 constitutes a sheet guide surface 110*a*, in which the three diagonal feed rollers 111 are exposed through roller holes 110*b*. The upper ends of the diagonal feed rollers 111 are substantially of the same height as the sheet guide surface 110*a*, making it possible to guide a sheet in a flat state. The rotating surfaces of the diagonal feed rollers 111 are inclined toward the rectifying plate 105 with respect to the sheet conveying direction.

On the lower side of the guide plate 110, there are formed a motor support portion 110*c*, roller support portions 110*d*, and a drive support portion 110*e*. Fixed to the drive support portion 110*e* is a driving motor 112, and rotatably supported by the roller support portions 110*d* are three driving shafts 113, 114, and 115 equipped with the diagonal feed rollers 111 at their distal ends. Pulleys 113*a*, 114*a*, 114*b*, and 115*a* are respectively fixed to the driving shafts 113, 114, and 115, and driving connection with the driving motor 112 is effected respectively by timing belts 116, 117, and 118. At a midpoint of the driving shafts 113, 114, and 115, there are respectively provided universal joints 113*b*, 114*c*, and 115*b*, making it possible to transmit rotation to the diagonal feed rollers 111 inclined with respect to the shaft of the driving motor 112.

In this embodiment, by arranging a plurality of diagonal feed rollers 111, it is possible to effect conveyance with the sheet side edge portion and the rectifying plate 105 parallel to each other when the sheet abuts the rectifying plate 105. That is, as compared with the case in which only one diagonal feed roller 111 is provided, it is possible to suppress unnecessary rotation at the time of abutment, so that the sheet can abut the rectifying plate 105 in a stable manner.

(Upper Guide Portion 102)

Figure 6A:
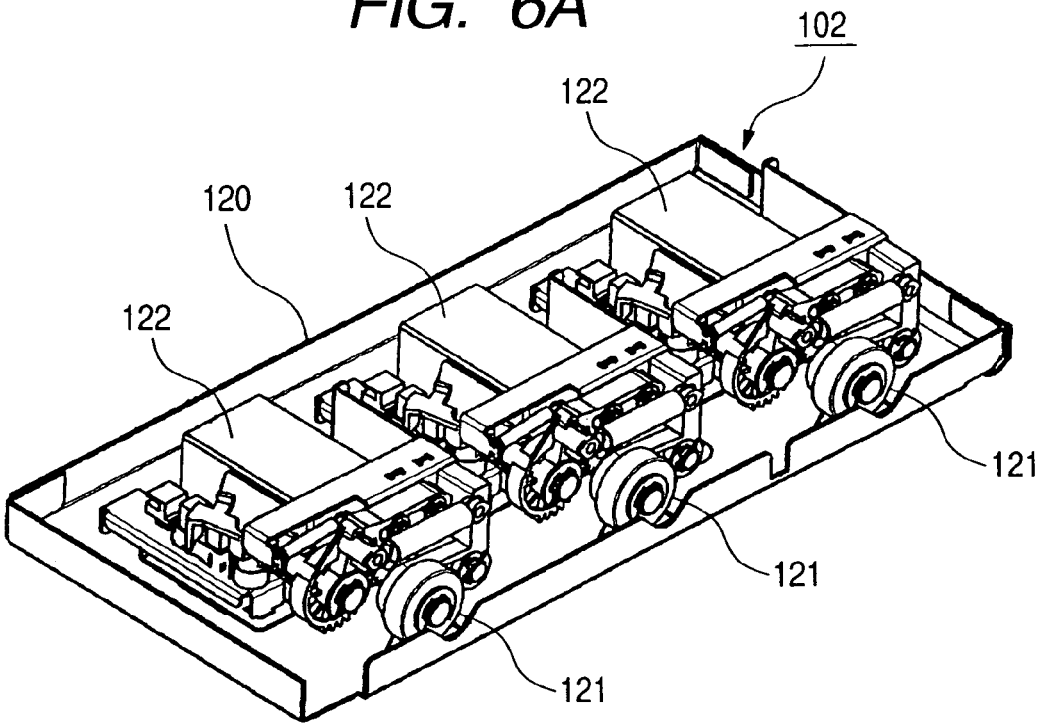
FIG. 6A is a perspective view of an upper guide portion of a diagonal feeding unit.
Figure 6B:
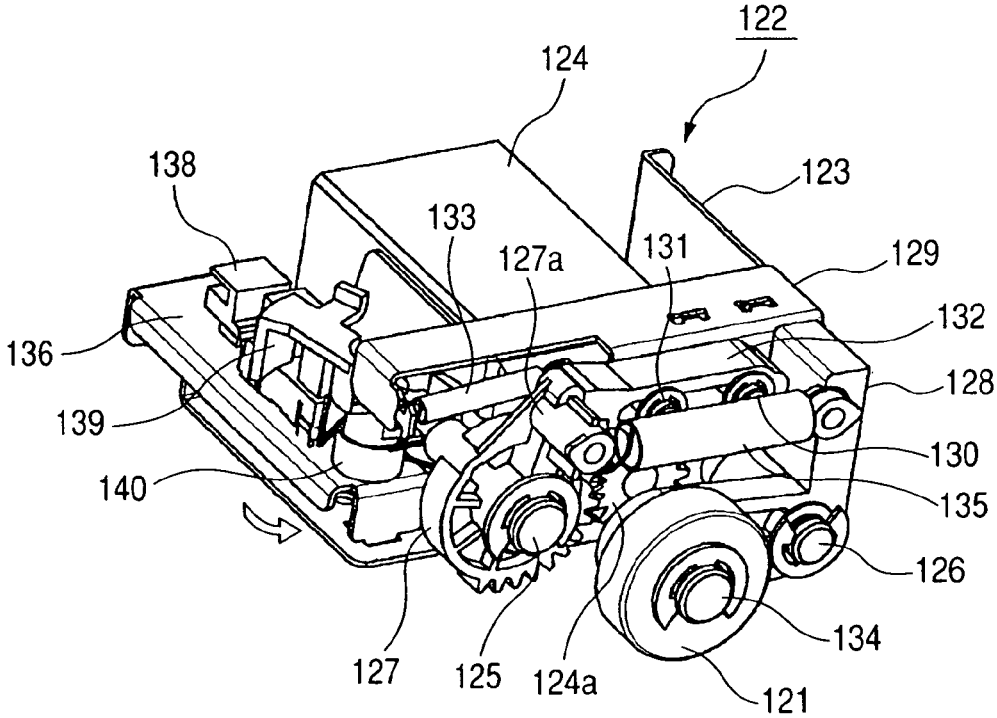
FIG. 6B is a perspective view of a roller pressurization unit.

FIGS. 6A and 6B are perspective views illustrating the upper guide portion of the diagonal feeding unit and the roller pressurization unit, and FIGS. 7A through 7F are diagrams illustrating the operation of the roller pressurization unit.

As shown in FIG. 6A, in the upper guide portion 102, there are provided on a guide plate 120 three diagonal feed runners 121 and three roller pressurization units 122 as an example of contact-separation means for causing them to effect separation and abutment. The diagonal feed runners 121 consist of rubber rollers, and their rotating surfaces are inclined toward the rectifying plate 105.

The roller pressurization unit 122 shown in FIG. 6B is a unit for causing the diagonal feed runner 121 to effect separation, abutment, and pressurization with respect to the diagonal feed roller 111.

A release motor 124 is fixed to a motor support plate 123, and drive force is transmitted to a pressurization adjustment gear 127 through a motor gear 124*a*. The pressurization adjustment gear 127 is rotatably supported by a gear shaft 125, and a spring peg portion 127*a* is provided at a position offset from the gear shaft 125.

The diagonal feed runner 121 is rotatably mounted to a shaft 134 provided at one end of a pressurization arm 128, and the pressurization arm 128 is rotatably mounted to the motor support plate 123 by an arm shaft 126. The other end of the pressurization arm 128 is connected to the spring peg portion 127*a* of the pressurization adjustment gear 127 by a tension spring 135, and the diagonal feed runner 121 is urged toward the diagonal feed roller.

Further, a release rod support plate 129 is fixed to the motor support plate 123, and an elongated hole of a release rod 132 is slidably fit-engaged with pins 130 and 131 provided thereon. The release rod 132 abuts an abutment portion 127*b* (see FIG. 7B) of the pressurization adjustment gear 127 and makes slide movement, abutting one end of the pressurization arm 128 to release the urging of the diagonal feed runner 121. The release rod 132 is connected to the release rod support plate 129 by a tension spring 133, and is urged toward the pressurization adjustment gear 127.

Further, a sensor support plate 136 is fixed to the motor support plate 123. A shaft 137 (see FIGS. 7A through 7F) and a sensor 138 are secured onto the sensor support plate 136, and a sensor flag 139 is rotatably supported by the shaft 137. The sensor flag 139 is urged in the direction indicated by the arrow in FIG. 6B (toward the position where the sensor is in the OFF-state) by a torsion spring 140, and rotates as the pressurization adjustment gear 127 rotates, turning ON/OFF the sensor 138.

Figure 7A:
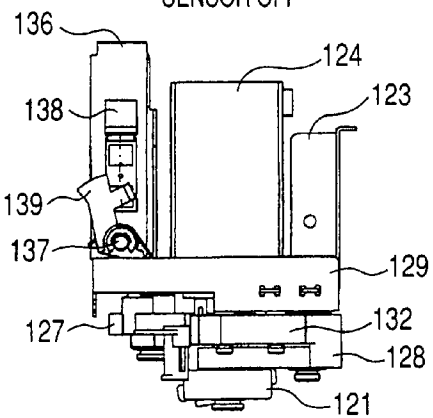
Figure 7B:
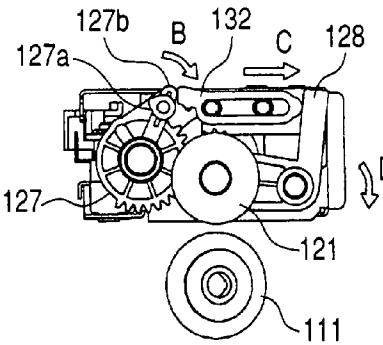
Figure 7C:
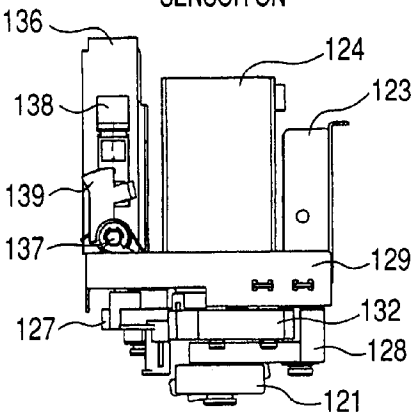
Figure 7D:
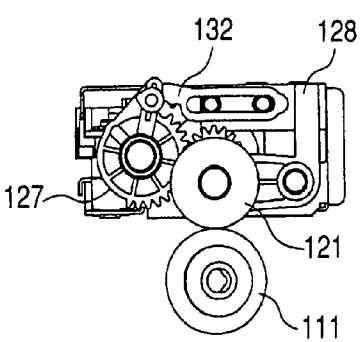

FIGS. 7C and 7D show a standby state. At this time, the abutment portion 127*b* of the pressurization adjustment gear 127 is not urging the release rod 132, and the pressurization arm 128 is urging the diagonal feed runner 121 toward the diagonal feed roller 111 by the urging force of the tension spring 135. At this time, the sensor 138 is in the ON-state.

FIGS. 7A and 7B show a pressure-released state. When the pressurization adjustment gear 127 rotates clockwise as seen in FIG. 7B (in the direction indicated by the arrow B), the abutment portion 127*b* of the pressurization adjustment gear 127 abuts the release rod 132, causing it to slide toward the pressurization arm 128 (in the direction indicated by the arrow C). When the release rod 132 abuts the pressurization arm 128, and further moves, the pressurization arm 128 rotates in the direction indicated by the arrow D in FIG. 7B against the urging force of the tension spring 135. As a result, the diagonal feed runner 121 is separated from the diagonal feed roller 111. At this time, the sensor 138 is in the OFF-state.

When, in this state, the pressurization adjustment gear 127 is rotated clockwise (in the direction indicated by the arrow A), the release rod 132 is returned by the urging force of the tension spring 133. With this, the pressurization arm 128 is also returned by the urging force of the tension spring 135, and a pressurizing force is generated the instant the diagonal feed runner 121 abuts the diagonal feed roller 111.

Figure 7E:
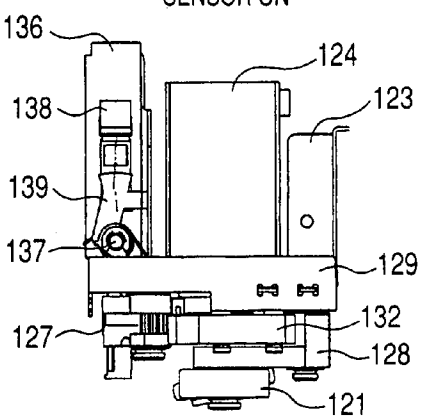
Figure 7F:
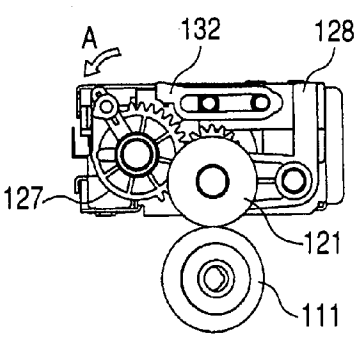

FIGS. 7E and 7F show the pressurizing state. When the pressurization adjustment gear 127 is further rotated counterclockwise (in the direction indicated by the arrow A) than in the standby state, the tension spring 135 is expanded, so that the pressurizing force of the diagonal feed runner 121 with respect to the diagonal feed roller 111 increases. In this way, it is possible to control the pressurizing force of the diagonal feed runner 121, so as to keep it substantially in proportion to the phase of the pressurization adjustment gear 127 (the rotating amount of the release motor 124). At this time, the sensor 138 is in the ON-state.

(Hinge Portion 103 and Base Portion 104)

Figure 8:
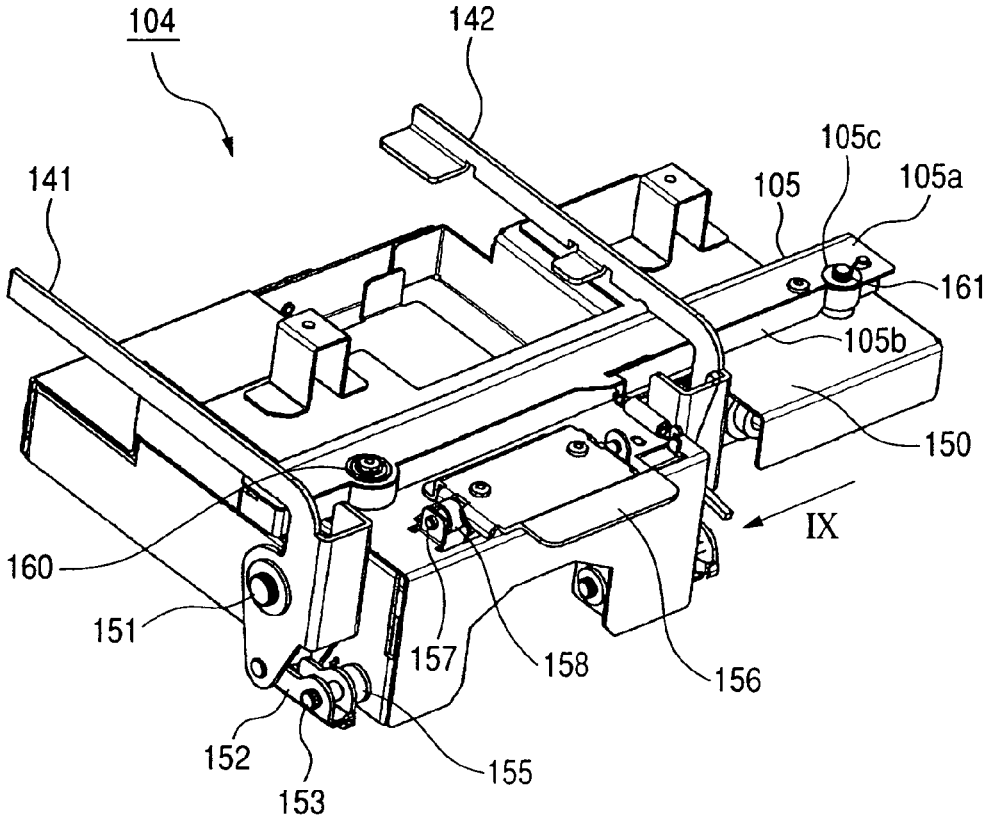
FIG. 8 is a diagram illustrating a hinge portion and a base portion 104.
Figure 9A:
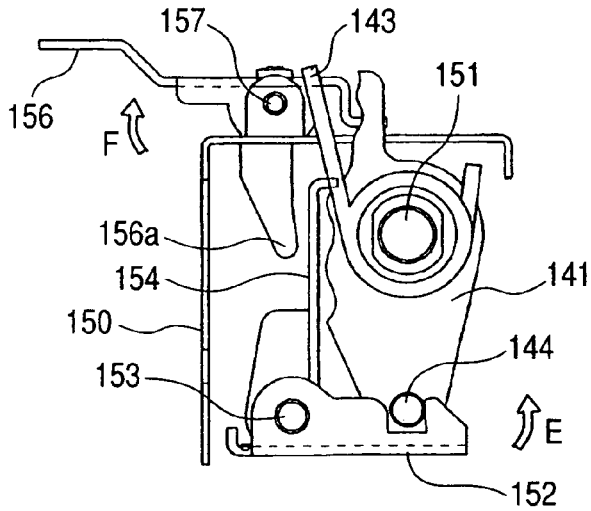
FIGS. 9A, 9B, and 9C are diagrams illustrating the operation of the hinge portion.
Figure 9B:
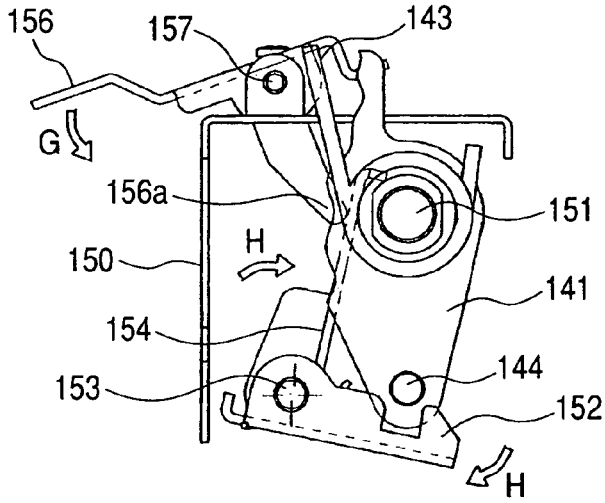
Figure 9C:
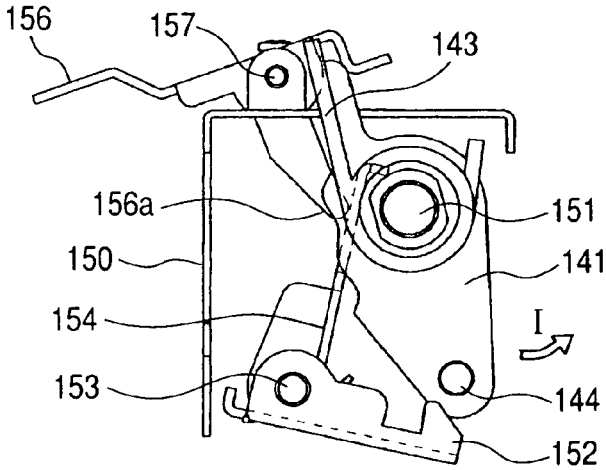

FIG. 8 is a view for explaining the hinge portion 103 and the base portion 104, and FIGS. 9A, 9B and 9C are views for explaining the operation of the hinge portion, as seen in the direction indicated by the arrow IX of FIG. 8.

The hinge portion 103 serves to support the upper guide portion 102 to the base portion 104 so as to be openable and closable. The hinge portion 103 is composed of symmetrical hinges 141 and 142; it is rotatably supported on a hinge shaft 151 provided in the base portion 104 and serves to fix the upper guide portion 102 in position. A torsion spring 143 is attached to the hinge shaft 151, urging the upper guide portion 102 so as to open. Further, the hinges 141 and 142 each has a lock shaft 144 protruding from its lower end. The closed state of the hinges 141 and 142 is retained through engagement of the lock shaft 144 with a hinge hook to be described later.

In the base portion 104, the hinge shaft 151 is fixed in each of two bilaterally symmetrical positions such that a base 150 is held therebetween. Provided in the vicinity of the hinge shaft 151 is a hook shaft 153, to which a hinge hook 152 and a hook release plate 154 (see FIGS. 9A through 9C) are rotatably attached. The hinge hook 152 and the hook release plate 154 are fixed to each other and rotate together, and are urged by a torsion spring 155, which is provided to the hook shaft 153, so as to bring the hinge hook 152 and the lock shaft 144 into engagement with each other (the direction indicated by the arrow E in FIG. 9A).

Further, the base 150 is provided with a release button 156 for releasing the engagement of the hinge hook 152. A release shaft 157 fixed to the release button 156 is rotatably supported on the base 150 and is urged toward an initial position (a position for not releasing the engagement of the hinge hook 152) shown in FIG. 9A by a torsion spring 158 (the direction indicated by the arrow F).

Now, when, as shown in FIG. 9B, the release button 156 is depressed (the direction indicated by the arrow G), a lower end 156*a* of the release button 156 abuts the hook release plate 154, causing the hook release plate 154 to rotate. As this happens, the hook release plate 154 and the hinge hook 152 rotate in the direction indicated by the arrow H against the urging force of the torsion spring 155 and are released from engagement with the lock shaft 144 of each of the hinges 141 and 142.

Then, as shown in FIG. 9C, the hinges 141 and 142 rotate due to the urging force of the torsion spring 143 so as to open the upper guide portion 102 (the direction indicated by the arrow I). Upon stopping the depression of the release button 156, the release button 156 and the hinge hook 152 return to their initial state due to the urging force of the torsion springs 155 and 158. When the upper guide portion 102 is pushed downward in this state, the lock shaft 144 abuts an inclined surface 152*a* of the distal end of the hinge hook 152, temporarily pushing the hinge hook 152 aside to rotate the same, whereby the hinge hook 152 and the lock shaft 144 are brought into engagement with each other again.

Further, the rectifying plate 105 is adjustably fixed onto the base portion 104. The rectifying plate 105 is composed of an upper guide 105*a* and a support stand 105*b*. The rectifying plate 105, which is fixed in position by means of adjusting shafts 160 and 161, is rotatable about the adjusting shaft 160, and an adjustment hole 105*c* is fitted over the adjusting shaft 161 with a play therebetween. Positional adjustment can thus be performed through the adjusting shaft 161, making it possible to adjust the attitude of the rectifying plate 105 with respect to the sheet conveying direction.

<Stationary Guide Portion 200>

Figure 10A:
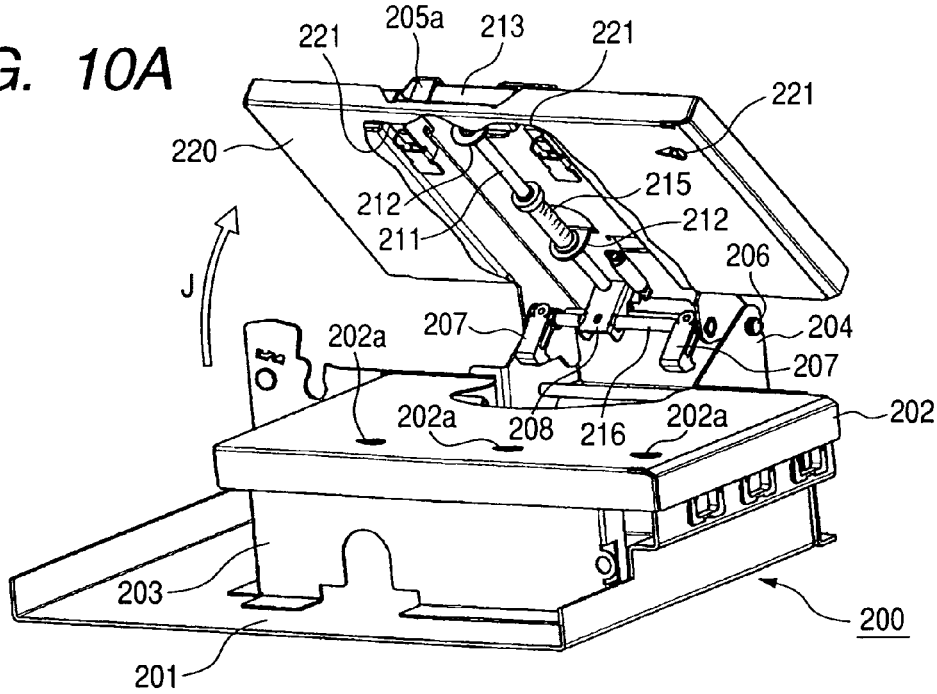
FIGS. 10A and 10B are perspective views illustrating the construction of a stationary guide portion.
Figure 10B:
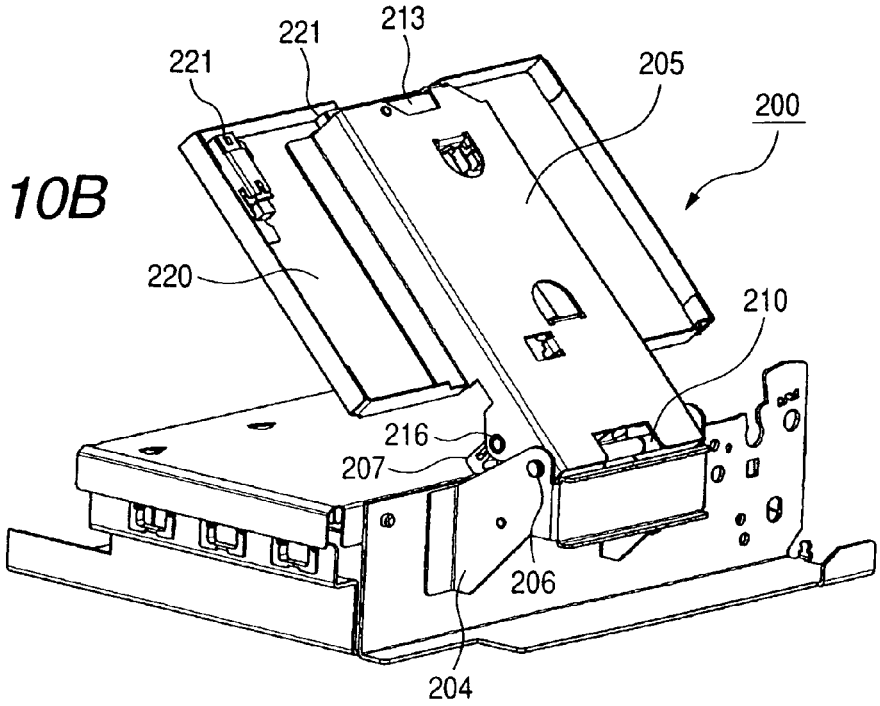
Figure 11C:
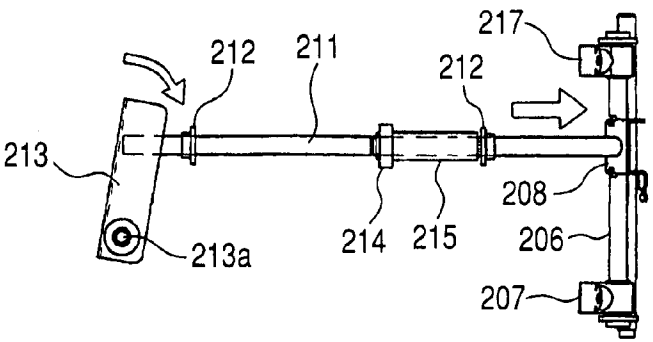
FIGS. 11A and 11C are plan views illustrating a release lever portion.
Figure 11A:
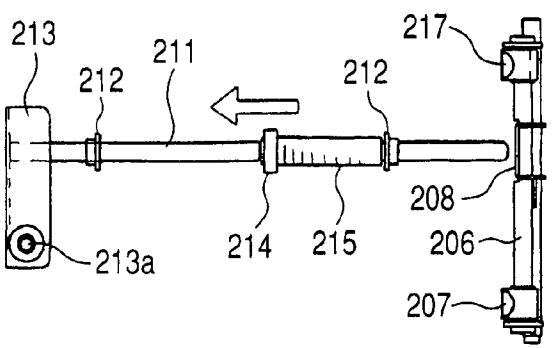
Figure 11D:
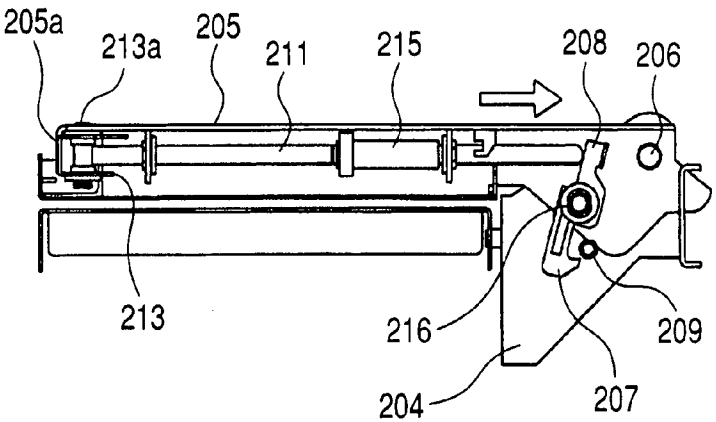
FIGS. 11B and 11D are sectional views of the release lever.
Figure 11B:
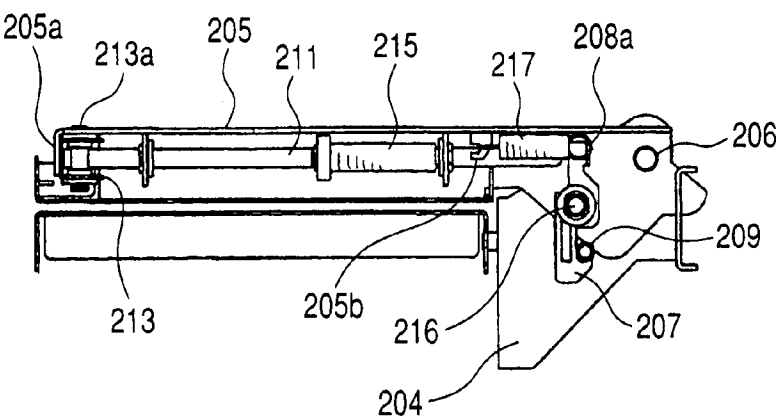
Figure 12:
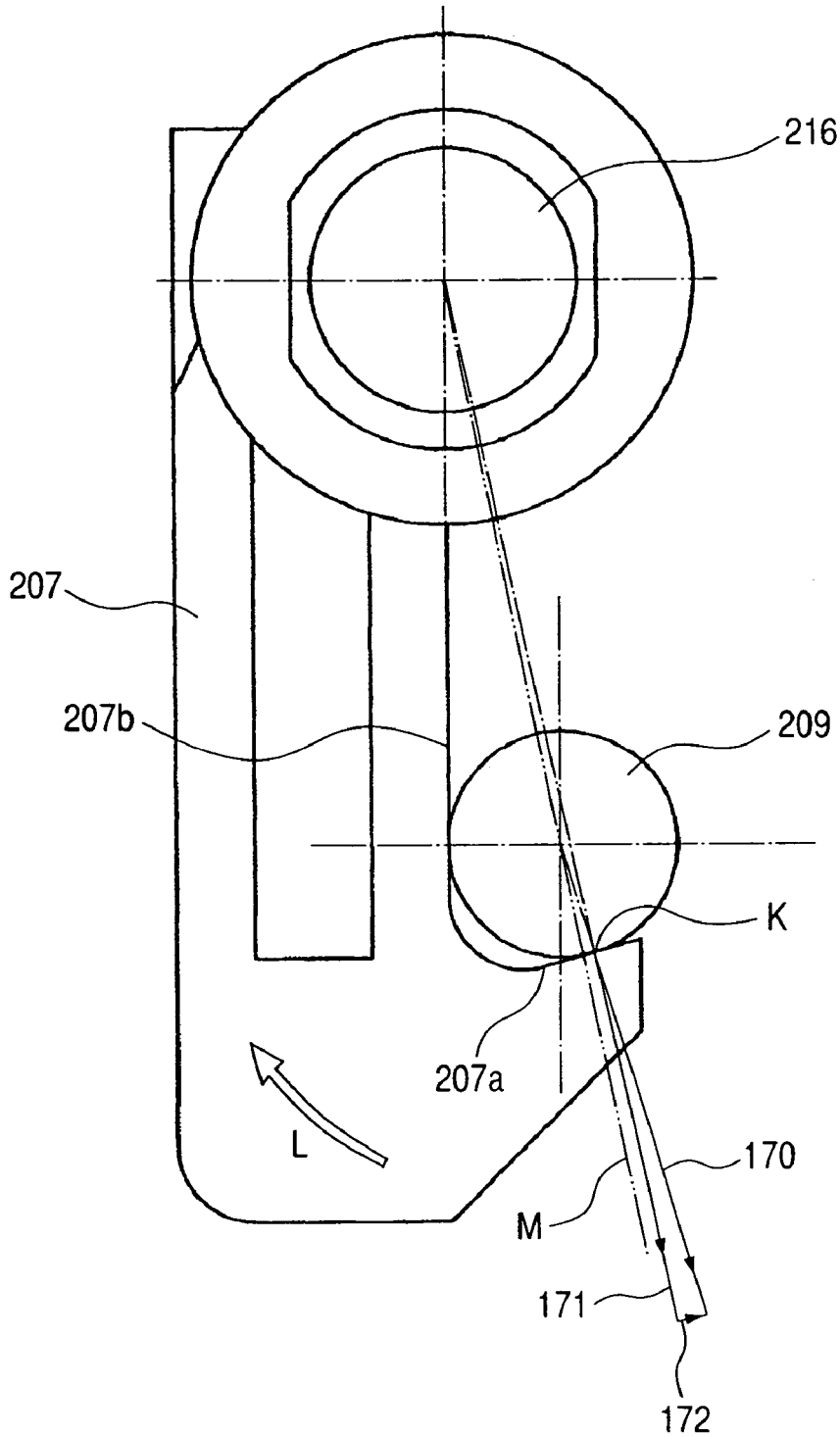
FIG. 12 is a detailed explanatory view of a release hook portion.

FIGS. 10A and 10B are perspective views for explaining the construction of the stationary guide portion, FIGS. 11A and 11C are explanatory plan views of a release lever portion, FIGS. 11B and 11D are sectional views of the release lever portion, and FIG. 12 is a detailed explanatory view of a release hook portion.

As shown in FIG. 10A, a lower guide portion 201 of the stationary guide portion 200 is fixed to a frame 201 through the intermediation of a support plate 203. A hinge stand 204 is fixed to the frame 201, with a hinge plate 205 being rotatably supported to the hinge stand 204 by means of a hinge shaft 206. An upper guide portion 220 is detachably fixed to the hinge plate 205 with a screw or the like. The upper guide portion 220 is provided with a plurality of optical sheet sensors 221 for detecting the position of a sheet on the conveying path. On the other hand, provided at positions of the lower guide portion 202 opposed to the optical sheet sensors 221 are holes 202*a* for preventing reflection of infrared rays.

As shown in FIG. 10B, arranged coaxial with the hinge shaft 206 is a torsion spring 210, which urges the hinge plate 205 so as to open (the direction indicated by the arrow J). Further, the hinge stand 204 is provided with a hook shaft 216. Hooks 207 and a release plate 208 that are fixed at predetermined phases are rotatably supported on the hook shaft 216. On the other hand, non-rotatably fixed to the hinge stand 204 is a lock shaft 209, with which the hook 207 engages to thereby fix the rotation of the hinge plate 205.

As shown in FIGS. 11A and 11B, in the hinge plate 205, a release bar 211 is slidably supported on bearings 212. The release bar 211 is capable of abutting the release plate 208 at one end and capable of abutting a release button 213 at the other end. Although rotatable about a shaft 213*a*, the release button 213 has its rotation restricted by a stopper 205*a* provided in the hinge plate 205. The release bar 211 is equipped with a compression spring 215 between a flange 214 provided to the release bar 211 and the bearings 212. The release bar 211 is thus urged toward the release button 213. That is, the release bar 211 is held in abutment with the release button 213 at all times, with the release button 213 being normally urged against the stopper 205*a*.

Further, a spring peg portion 205*b* of the hinge plate 205 and a spring peg portion 208*a* of the release plate 208 are connected with each other by a tension spring 217. As a result, the hook 207 is urged toward the lock shaft 209 at all times. It is to be noted that even when the hook 207 is not in locking engagement with the lock shaft 209, the release plate 208 has its rotation restricted upon abutting the release bar 211, which in turn has its movement restricted by the stopper 205*a* as described above. This prevents the release plate 208 from rotating excessively to approach the spring peg portion 205*b* beyond the natural length of the tension spring 217, causing the tension spring 217 to dislodge from the spring peg portions 205*a* and 208*a*.

When, as shown in FIGS. 11C and 11D, the release button 213 is rotated by pushing it in toward the release bar 211, the release bar 211 slides against the urging force of the compression spring 215, causing the release plate 208 to rotate against the urging force of the tension spring 217. This causes the hook 207 to rotate, thereby releasing its engagement with the lock shaft 209. As this happens, the hinge plate 205 rotates in its opening direction due to the urging force of the torsion spring 210.

Referring to FIG. 12 now, at the contact K between the hook 207 and the lock shaft 209, the urging force of the torsion spring 210 acts as a rotation force L with the hinge shaft 206 as the center (for the hook shaft 216, see FIG. 11B). Accordingly, a force represented by a vector 170 acts at the contact K between the hook 207 and the lock shaft 209 in the direction normal to the contact K of the lock shaft 209. The vector 170 can be decomposed into a vector 171 on the straight line connecting between the center of the hook shaft 216 and the contact K, and a vector 172 tangential to the contact K of the lock shaft 209. At this time, an inclined surface 207*a* of the hook 207 is determined such that the vector 172 acts in the direction reverse to the direction for releasing the hook 207, whereby the position of the hook 207 is uniquely determined to be the position where a shaft portion 207*b* abuts the lock shaft 209. Accordingly, the engagement between the hook 207 and the lock shaft 209 is not released unless the release plate 208 is pressed, thereby preventing spontaneous or abrupt disengagement. That is, the angle of the inclined surface 207*a* is determined such that the contact K between the hook 207 and the lock shaft 209 is located opposite to the shaft portion 207*b* of the hook 207 with respect to a line M connecting between the center of the hook shaft 216 and the center of the lock shaft 209.

<Diagonal Feed Guide Jogging Portion 300>

Figure 13A:
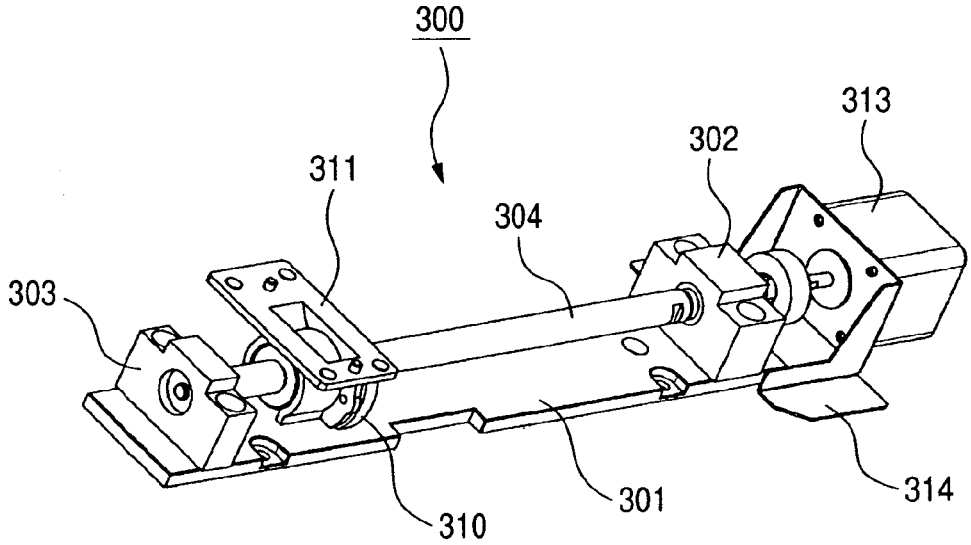
FIGS. 13A and 13B are a perspective view and a sectional view illustrating a diagonal feed guide jogging portion 300.
Figure 13B:
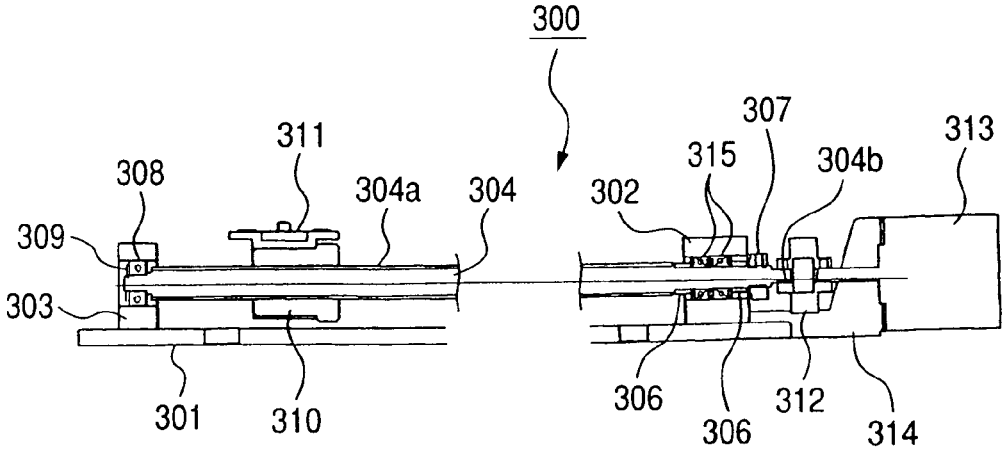

FIGS. 13A and 13B are explanatory perspective and sectional views, respectively, of the diagonal feed guide jogging portion 300.

As shown in FIG. 13A, the diagonal feed guide jogging portion 300 has a first bearing stand 302 and a second bearing stand 303 that are fixed onto a base portion 301, which is fixed to the frame 201 (see FIG. 10A). Further, a lead screw 304 is rotatably supported to the first bearing stand 302 and the second bearing stand 303.

As shown in FIG. 13B, multiple rows of angular ball bearings 305 are press fitted in the first bearing stand 302. Further, the angular ball bearings 305 are fixed to the lead screw 304 by means of a lock nut 307 through the intermediation of two spacers 306. Accordingly, when the lock nut 307 is fastened with a predetermined torque and as the plays between the angular ball bearings 305 arranged in multiple rows are filled up, the position of the lead screw 304 is uniquely determined with respect to the first bearing stand 302.

In the second bearing stand 303, deep groove ball bearings 308 are fitted with a predetermined gap therebetween. The deep groove ball bearings 308 and the lead screw 304 are fitted with a predetermined gap therebetween. Further, a C-ring 309 is attached to the distal end of the lead screw 304 to prevent dislodging of the deep groove ball bearings 308.

A nut 310 is rotatably attached to a spline portion 304*a* of the lead screw 304. Fixed to the nut 310 is a bracket 311 for effecting connection with the diagonal feed roller guide portion 100. The lead screw 304 and the nut 310 consist of ball screws, with balls (not shown) being incorporated in the nut 310. This enables improved accuracy and reduced noise in moving the diagonal feed roller guide portion 100. A motor 313 is connected to a distal end portion 304*b* of the lead screw 304 through the intermediation of a coupling 312, thereby absorbing the misalignment between the respective rotation centers of the motor 313 and the lead screw 304. The motor 313 is fixed to a motor support plate 314.

<Registration Roller Portion 400>

Figure 14:
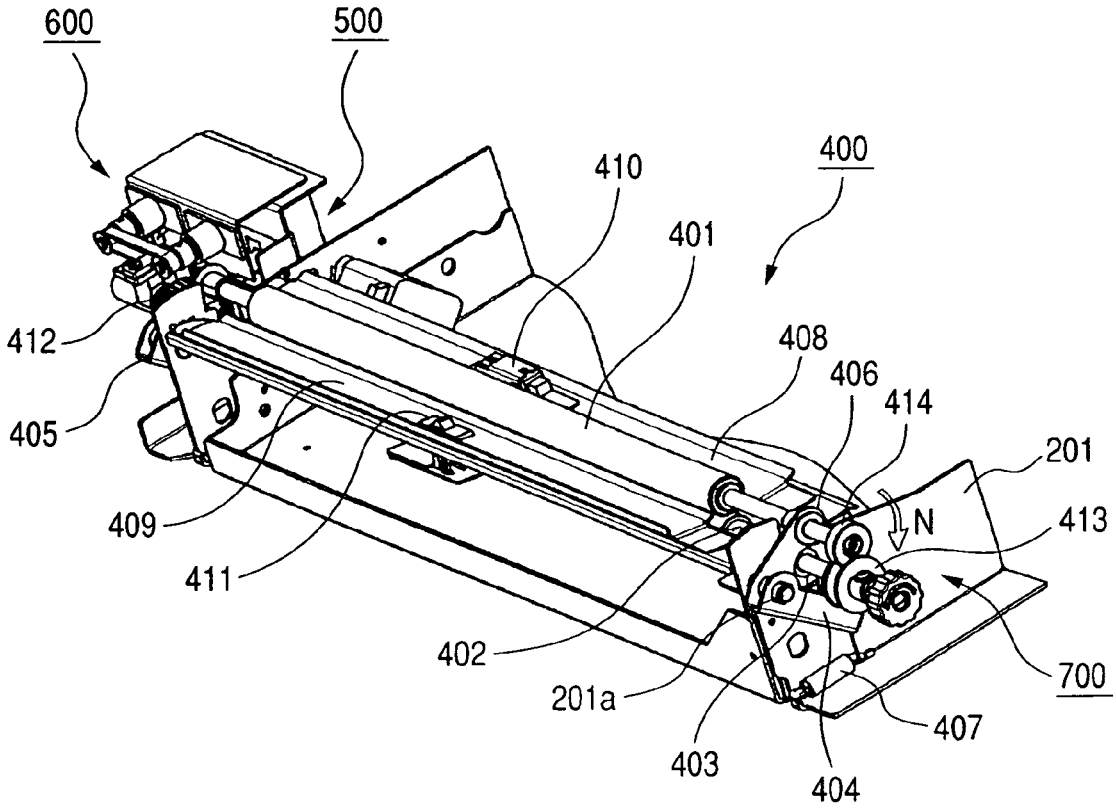
FIG. 14 is a perspective view illustrating a registration roller portion 400.

FIG. 14 is an explanatory perspective view of the registration roller portion 400. The registration roller portion 400 is driven to rotate at predetermined speed and timing by the registration roller driver portion 500. Further, the registration roller portion 400 is movable in the sheet width direction (direction orthogonal to the sheet conveying direction) by means of the registration roller slider portion 600, with the registration roller pressure releasing portion 700 effecting contact and separation at the nip.

The registration roller portion 400 is composed of an upper roller 401 and a lower roller 402. The lower roller 402 is rotatably supported on a slide bearing 403 fixed onto the frame 201. Further, the upper roller 401 is rotatably supported on a slide bearing 406 fixed onto each of pressurization arms 404 and 405. The pressurization arms 404 and 405 are rotatably fixed to the shaft 201*a* formed in the frame 201, and both serve to pressurize the upper roller 401 against the lower roller 402 by means of a tension spring 407 (the direction indicated by the arrow N).

A registration roller gear 412 is fixed to one end of the lower roller 402 (see FIG. 15), allowing transmission of the drive force from the registration roller driver portion 500 to the lower roller 402. Fixed to the other end of the lower roller 402 is a runner receiver 413, which engages a runner 414 rotatably supported to the upper roller 401.

Further, an entrance guide 408 and an exit guide 409 are fixed to the frame 201 at positions on the upstream and downstream sides, respectively, of the registration roller pair (the upper roller 401 and the lower roller 402) with respect to the sheet conveying direction. Provided on the guides 408 and 409 are sheet detecting sensors 410 and 411 for detecting the sheet being passed, respectively. Optical sensors are used as the sheet detecting sensors 410 and 411.

<Registration Roller Driver Portion 500>

Figure 15:
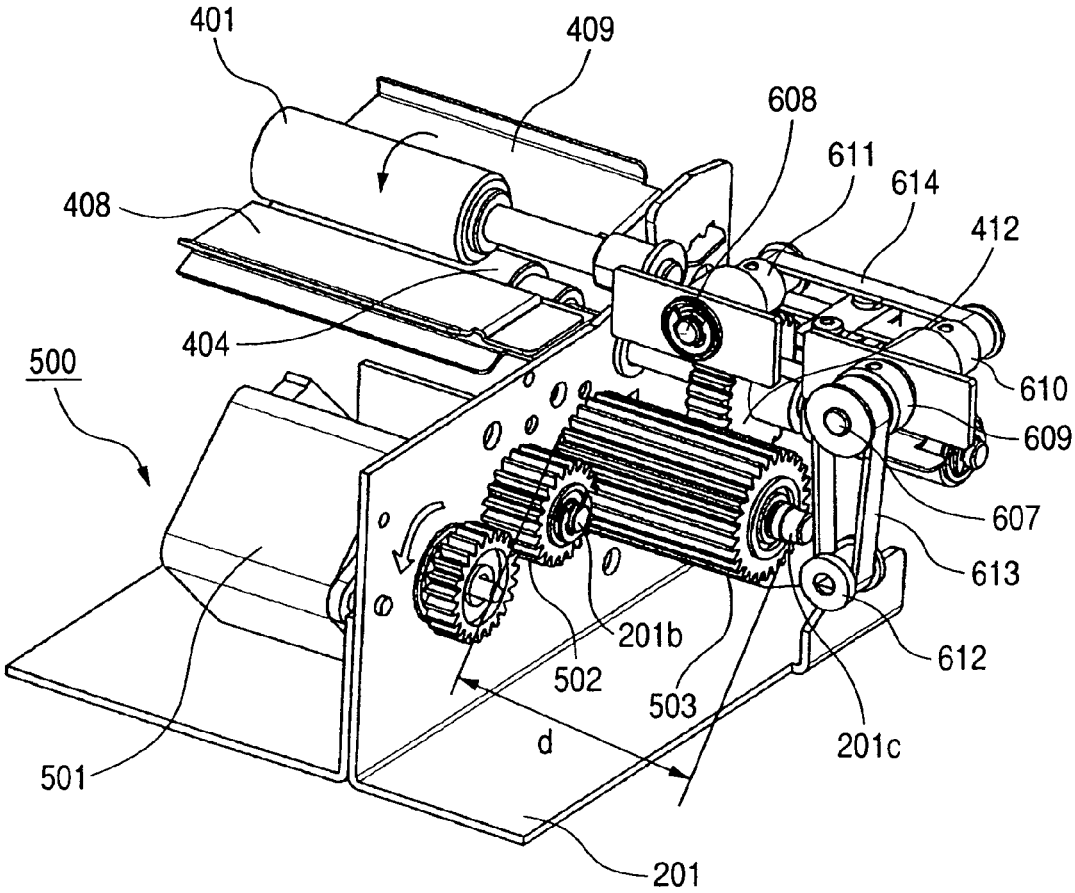
FIG. 15 is a diagram illustrating a registration roller driver portion.

FIG. 15 is an explanatory view of the registration roller driver portion. As shown in FIG. 15, the drive force of a motor 501 fixed to the frame 201 is transmitted to the registration roller gear 412 by way of drive gears 502 and 503. Further, in order to prevent the drive gear 503 from coming out of meshing engagement as the registration roller gear 412 reciprocates, the tooth surface of the drive gear 503 has a length "d" larger than the reciprocation width of the registration roller gear 412.

The drive gear 502 and the drive gear 503 are rotatably fixed to a stationary shaft 201*b* and a stationary shaft 201*c*, respectively, of the frame 201 through the intermediation of bearings. The motor 501 rotates counterclockwise as viewed from the motor 501 mounting surface side. The motor 501 is a stepping motor in this embodiment.

<Registration Roller Slider Portion 600>

Figure 16:
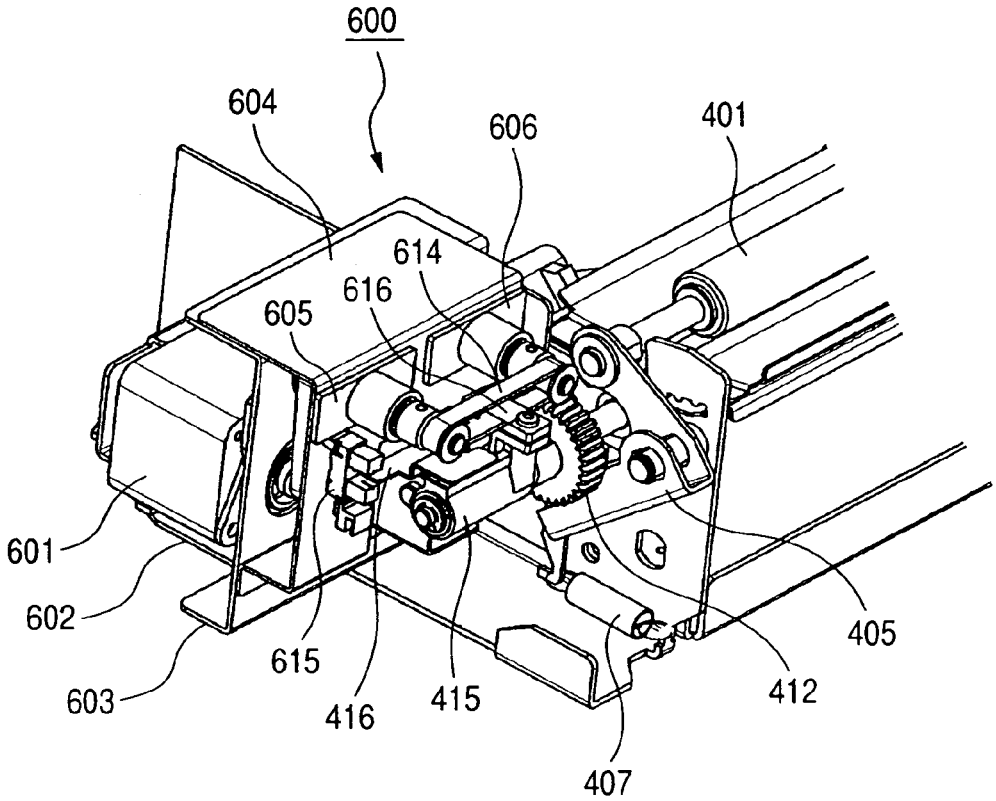
FIG. 16 is a partially omitted view illustrating a registration roller slider portion.

The registration roller slider portion is described with reference to FIGS. 15 and 16. FIG. 16 is a partially omitted explanatory view of the registration roller slider portion.

A slide motor 601 is fixed to a motor stand 602 and screwed onto a motor support plate 603. A pulley support plate 604 is screwed onto the motor support plate 603 so as to be opposed to the slide motor 601. A first pulley stand 605 and a second pulley stand 606 are fixed to the pulley support plate 604. A first pulley shaft 607 and a second pulley shaft 608 are rotatably fixed to the first pulley stand 605 and the second pulley stand 606, respectively. Further, a first pulley 609 and a second pulley 610 are fixed to the first pulley shaft 607, and a third pulley 611 is fixed to the second pulley shaft 608. Further, a fourth pulley 612 is fixed to the distal end of the output shaft of the slide motor 601. A timing belt 613 is suspended between the first pulley 609 and the fourth pulley 612, and a timing belt 614 is suspended between the second pulley 610 and the third pulley 611. Further, the motor stand 602 and the second pulley stand 606 are mounted so as to be capable of center distance adjustment, thus enabling mounting under an arbitrary belt tension.

On the other hand, a holder 415 is rotatably supported to the registration roller gear 412 side end portion of the lower roller 402 through a bearing. Attached to the holder 415 is a sensor flag 416 for detecting the home position (hereinafter referred to as "HP") of the registration roller pair (401 and 402) with respect to the sheet width direction. The sensor flag 416 can be detected by a sensor 615 provided to the pulley support plate 604. Further, the holder 415 is fixed to the timing belt 614 by means of a stopper 616 and a screw.

With the above-described construction, the timing belt 614 rotates and moves as the slide motor 601 rotates, allowing the lower roller 402 of the registration roller pair to reciprocate in the sheet width direction (direction orthogonal to the conveying direction). Further, the upper roller 401 reciprocates in synchronism with the lower roller 402 due to the runner receiver 413 and the runner 414 shown in FIG. 14.

When the reduction ratio between the first pulley 609 and the fourth pulley 612 is "i", the pitch of the timing belt 614 is "p" (mm), the number of teeth of the second pulley 610 is "t", and the step angle of the slide motor 601 is "s" (deg), the amount of movement "1" (mm) of the registration roller pair (401 and 402) per one pulse of the slide motor 601 is given by the following expression.

$$l = \frac{i * s * p * t}{360}$$

For example, the following is obtained when P=2 (mm), t=15, i=(15/22), and s=1.8 (deg), enabling control at a pitch of approximately 0.1 mm as follows.

$$l = \frac{15/22 * 1.8 * 2 * 15}{360} = 0.1022(\text{mm})$$

Further, a micro-step division setting may be adopted as the mode of the slide motor 601 to allow even finer movement control.

<Registration Roller Pressure Releasing Portion 700>

Figure 17A:
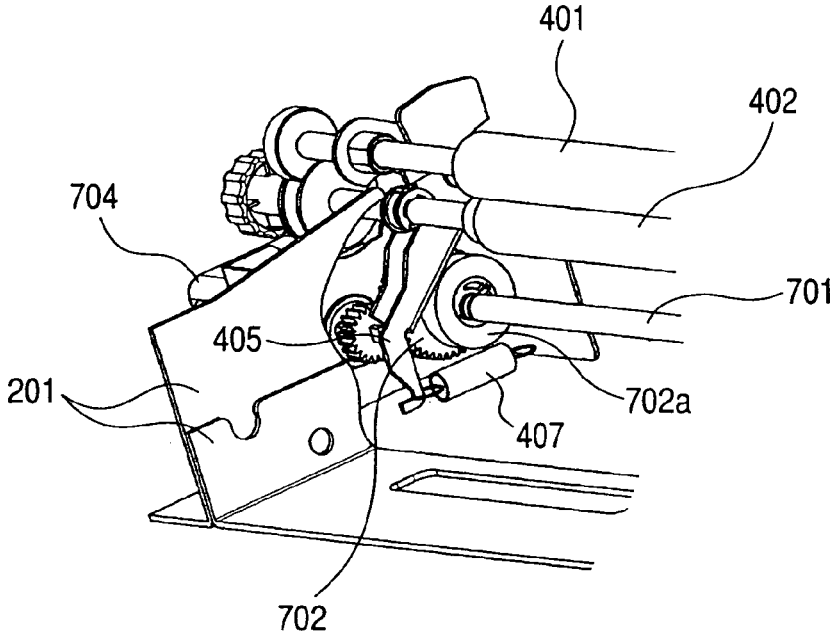
FIG. 17A is a perspective view illustrating a registration roller pressure releasing portion.
Figure 17B:
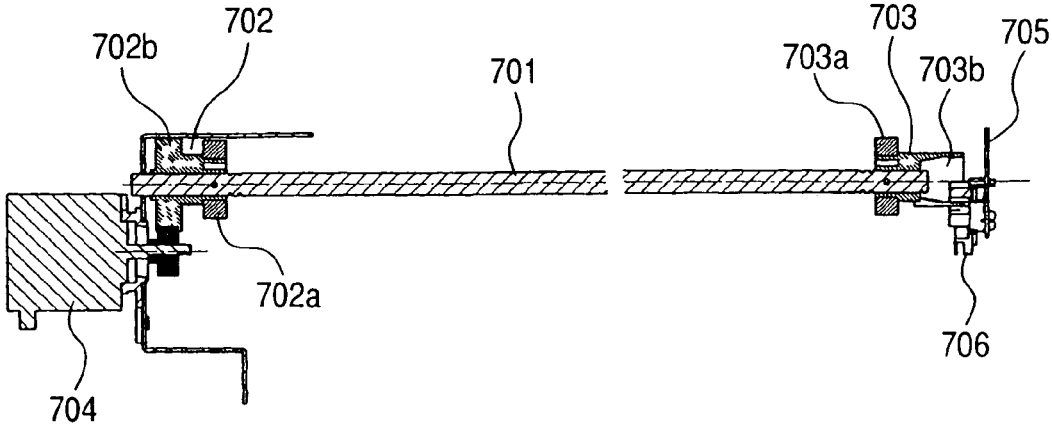
FIG. 17B is a sectional view illustrating the registration roller pressure releasing portion.

FIGS. 17A and 17B are explanatory views of the registration roller pressure releasing portion, of which FIG. 17A is a main portion perspective view, and FIG. 17B is a main portion sectional view.

As shown in FIG. 17A, the registration roller pressure releasing portion 700 is composed of a pressure release shaft 701 supported by a bearing positioned with respect to the frame 201, and a first release cam 702 and a second release cam 703 each fixed to the pressure release shaft 701 with a parallel pin. In the first release cam 702 and the second release cam 703, deep groove ball bearings 702*a* and 703*a* are press fitted at positions eccentric from the respective rotation centers of the first release cam 702 and the second release cam 703. Further, a gear 702*b* is formed in the first release cam 702, whereby the drive force of a registration release motor 704 is transmitted through the first release cam 702 to rotate the pressure release shaft 701.

The deep groove ball bearings 702*a* and 703*a* are each in abutment with the pressurization arm 405. When the pressure release shaft 701 is rotated by one turn, the deep groove ball bearings 702*a* and 703*a* cause the pressurization arm 405 to rock against the urging force of the spring 407, whereby the upper roller 401 can be pressurized against and released from the lower roller 402 for one time each.

A sensor flag 703*b* is formed in the second release cam 703. The phase of the pressure release shaft 701 is detected by a detection sensor 706 positioned and fixed onto a sensor support plate 705 that is fixed to the frame 201, thereby controlling the rotation of the registration release motor 704. Further, the phases of the first release cam 702 and the second release cam 703 are determined such that the sensor flag 703*b* blocks the detection sensor 706 during the pressurizing operation.

{Description of Characteristic Operation of This Embodiment}

Figure 18:
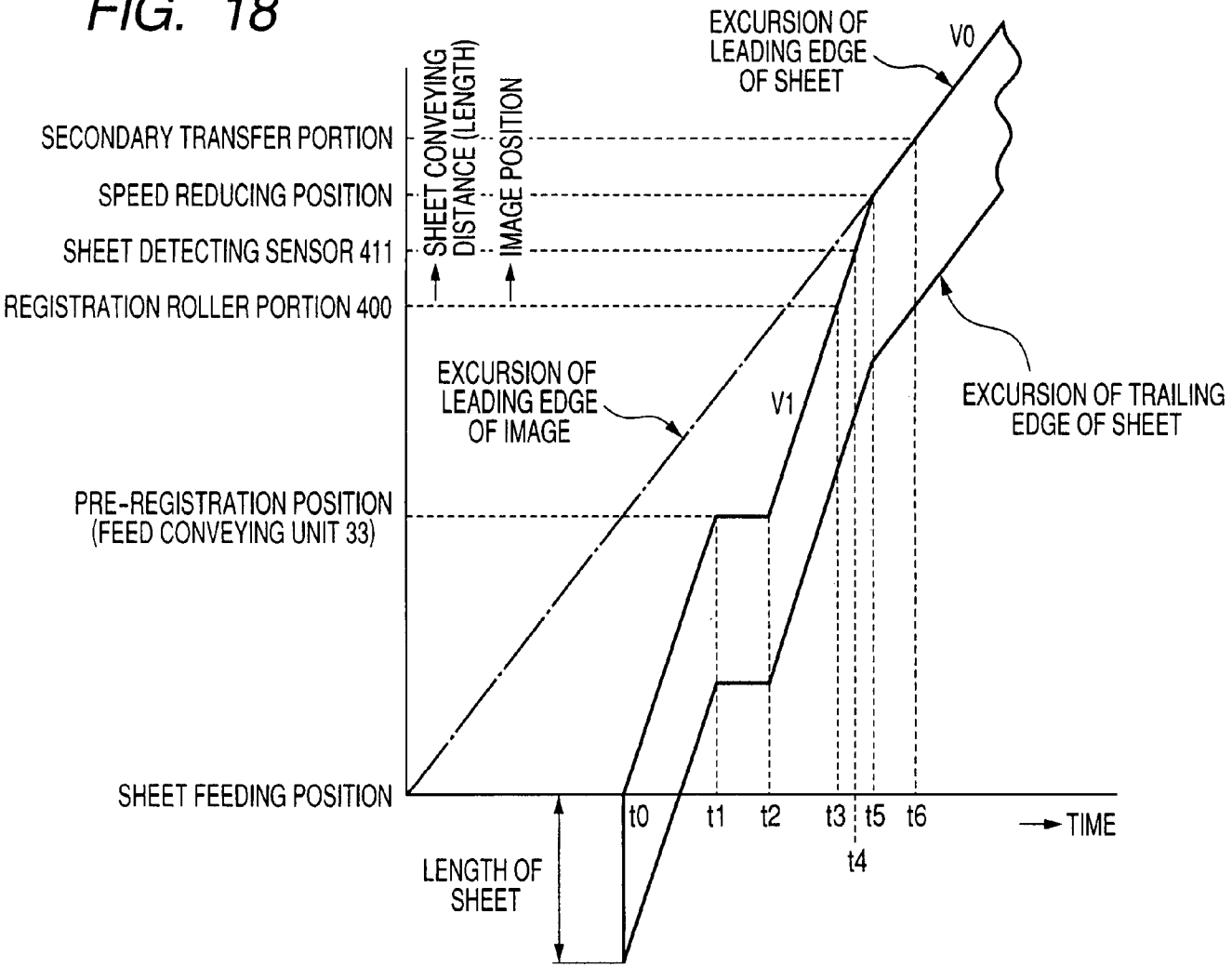
FIG. 18 is a diagram showing the relationship between elapsed time and sheet conveying distance.

Next, the characteristic operation of the registration portion 34 according to this embodiment is described with reference to FIGS. 1, 2, 18, and 19A through 19E. FIG. 18 is a diagram showing the relationship between the elapsed time and the sheet conveying distance, and FIGS. 19A through 19E are diagrams for explaining the operation of the registration portion 34.

First, when feeding of a sheet from the feeding unit 30 is started (time t0), as described above, the sheet conveyance is temporarily stopped within the feed conveying unit 33 (pre-registration processing), thus absorbing unevenness of conveyance (time t1 to t2). Then, the sheet is conveyed from the feed conveying unit 33 to the registration portion 34. It is to be noted that, in the apparatus of the present invention, the sheet is conveyed based on the center reference, whereby the center of the conveying path and the center of the sheet being conveyed are in alignment with each other.

Figure 19A:
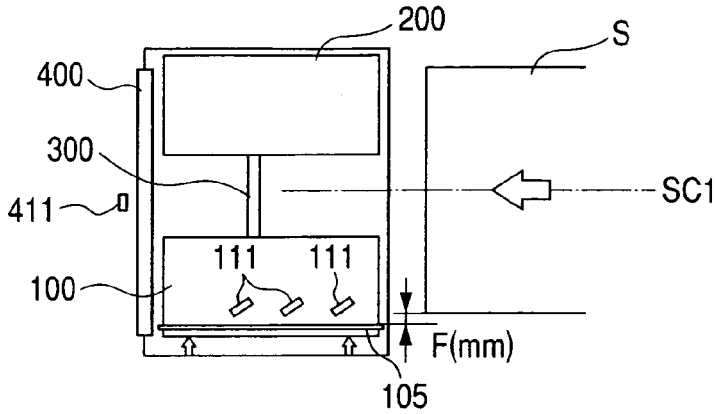
FIGS. 19A, 19B, 19C, 19D and 19E are diagrams illustrating the operation of a registration portion 34.

As shown in FIG. 19A, when the sheet is to be conveyed to the registration portion 34, the diagonal feed roller guide portion 100 is moved by the diagonal feed guide jogging portion 300 in advance so that the rectifying plate 105 of the diagonal feed roller guide portion 100 is located at a predetermined distance F (mm) from the side edge portion of the sheet S that is conveyed in a normal, correct manner with a center SC1 of the conveying path as a reference. In this regard, while the sheet S is conveyed with the center SC1 as the reference, in actuality, the sheet S may be somewhat deviated from the center SC1 due to conveyance errors. Accordingly, a value allowing some margin of tolerance should be set as the above predetermined distance F (mm). That is, the rectifying plate 105 is positioned at the position spaced apart from the center SC1 by a distance corresponding to the half of the width of the sheet S being conveyed plus the predetermined distance F. At this time, high-accuracy positioning can be effected on the rectifying plate 105 of the diagonal feed roller guide portion 100 since ball screws are used for the lead screw 304 and the nut 310 of the diagonal feed guide jogging portion 300.

Figure 19B:
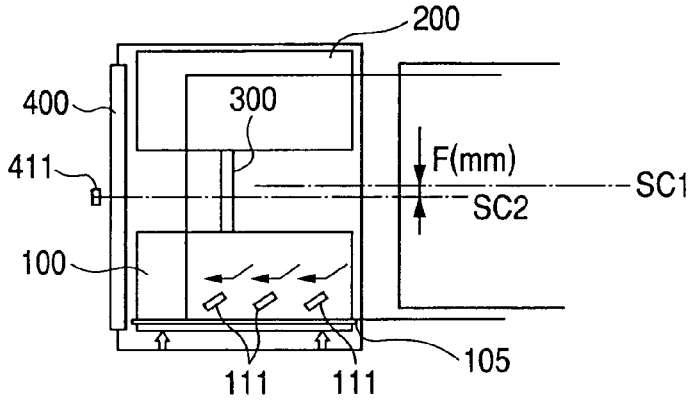

As shown in FIG. 19B, as it is nipped and conveyed by the diagonal feed rollers 111 in the registration portion 34, the sheet is conveyed diagonally toward the rectifying plate 105 and abuts the rectifying plate 105 before being conveyed along the rectifying plate 105. As a result, the skew feed of the sheet is corrected and the side edge portion of the sheet is regulated by the rectifying plate 105, whereby the center of the sheet is brought into correct alignment with an offset center SC2.

Figure 19C:
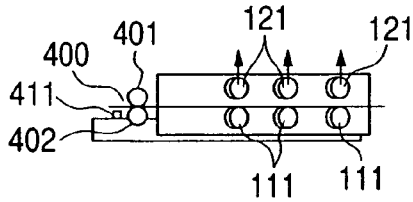
Figure 19D:
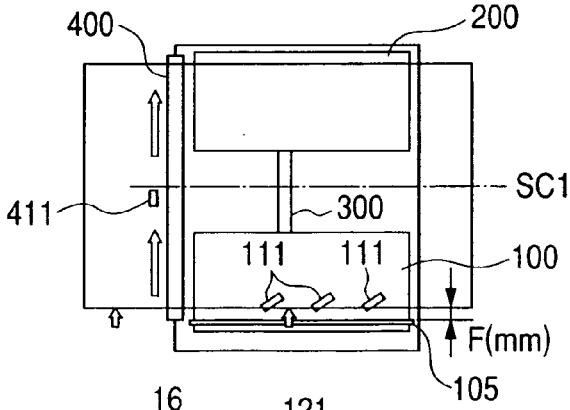
Figure 19E:
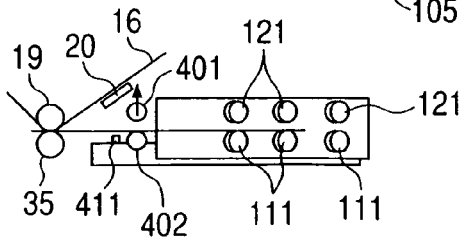

When, as shown in FIG. 19C, the leading edge of the sheet enters the registration roller portion 400 (time t3), this is detected by the sheet detecting sensor 411 arranged on the downstream side of the registration roller portion 400 (time t4). As this happens, all the diagonal feed runner 121 are subjected to pressure release by the roller pressurizing unit 122 (see FIG. 6B) and separate from the diagonal feed rollers 111. This results in the state where the sheet is conveyed solely by the registration roller portion 400. At the time, the registration roller portion 400 is rotating at a speed V1 faster than a transfer speed V0 at the secondary transfer portion (the nip between the inner secondary transferring roller 19 and the outer secondary transferring roller 35).

After the diagonal feed runners 121 thus separate from the diagonal feed rollers 111, the registration roller slider portion 600 is driven and the registration roller portion 400 is moved toward the stationary guide portion 200 by the predetermined distance F (mm). As a result, the center of the sheet is accurately aligned with the intended center SC1.

Based on the passage time of the sheet detecting sensor 411 and the information of the toner patch reading means 20, computing means (not shown) computes the synchronization between the image and the sheet at the secondary transfer portion. Then, at the time t5 thus calculated, the speed of the registration roller portion 400 is decelerated to the transfer speed V0. In this regard, the deceleration timing for the registration roller 400 is determined based mainly on the detection signal from the sheet detecting sensor 411. Accordingly, when the sampling frequency of the sheet detecting sensor 411 is f1 (Hz), and the drive frequency of the motor 501 of the registration roller driver portion 500 is f2 (Hz), f1 and f2 preferably satisfy the relationship of f1>f2. This enables high-accuracy control by fully exploiting the performance of the motor 501. It is to be noted that even more accurate control can be achieved by effecting microstep control on the motor 501.

When the sheet enters the secondary transfer portion (time t6), the upper roller 401 and the lower roller 402 of the registration roller portion 400 are subjected to pressure release by the registration roller pressure releasing portion 700. Thereafter, secondary transfer is performed as described above.

When the sheet trailing edge is detected by the sheet detecting sensor 411, the diagonal feed roller guide portion 100 is again moved by the diagonal feed guide jogging portion 300 so as to be located at the predetermined distance F (mm) from the side edge portion of the next sheet S to be conveyed. Then, the roller pressurizing unit 122 is driven prior to the arrival of the next sheet, thus abutting and pressurizing the diagonal feed runner 121 against the diagonal feed roller 111. Further, in the registration roller portion 400 as well, the registration roller pressure releasing portion 700 is driven to bring the upper roller 401 and the lower roller 402 into abutment and pressurization against each other. The registration roller portion 400 is then accelerated to the fast speed V1, leaving it ready for the next sheet.

As described above, when the sheets being continuously conveyed are of different sizes, the diagonal feed roller guide 100 is moved by the diagonal feed guide jogging portion 300 to a position corresponding to the size of the next sheet to be conveyed. When the sheets being continuously conveyed are of the same size, the diagonal feed roller guide 100 does not move but is held on standby at that position for the next alignment operation.

As described above, according to the skew feed correcting device of this embodiment, skew feed correction based on the side registration reference can be effected in an apparatus that conveys a sheet based on the sheet center reference. Accordingly, skew feed correction can be reliably effected even on high-rigidity sheets. Moreover, deviations with respect to the sheet width direction can be corrected even though the sheet is conveyed based on the sheet center reference.

Further, the conveying path is divided into the diagonal feed roller guide portion 100 and the stationary guide portion 200, making it possible to minimize the portions that must be moved according to each sheet size. A small motor can thus be used as the motor for driving the correction mechanism, thereby achieving reduced production cost and reduced apparatus size.

In the embodiment as described above, the sheet detecting sensor 411 arranged on the downstream side of the registration roller portion 400 is used to detect the sheet as it enters into or passes through the registration roller portion 400. It is also possible, however, to use the sheet detecting sensor 410 arranged on the upstream side of the registration roller portion 400 to detect the sheet, effecting determination based on the lapse of a predetermined period of time (predetermined conveying distance).

While the foregoing description is directed to the case where the lead screw 304 and the nut 310 of the diagonal feed guide jogging portion 300 each consist of a ball screw, this may be constructed by using a rack and pinion, or a timing belt, thus making it possible to construct the diagonal feed guide jogging portion 300 at low cost. Likewise, while in the foregoing description a timing belt is used for the registration roller slider portion 600, a rack and pinion may be used instead, or alternatively, a ball screw may be used to perform positioning control on the registration roller portion 400 with even higher accuracy.

While the embodiment described above is directed to the example in which the skew feed correcting device is installed in an image forming apparatus, the skew feed correcting device of the present invention may also be installed in a sheet feeding apparatus equipped with sheet stacking means for stacking and accommodating the sheet (e.g. a feeding unit) and with sheet delivery means for delivering the sheet from the sheet stacking means (e.g. a feeding/separation unit). Likewise, the advantages of the present invention can be realized also when the skew feed correcting device of the present invention is installed in an image reading apparatus equipped with image reading means for reading an image on the sheet.

This application claims priority from Japanese Patent Application No. 2004-132959 filed on Apr. 28, 2004, which is hereby incorporated by reference herein.

What is claimed is:

1. A sheet conveying apparatus comprising a skew feed correcting device for correcting skew feed of a sheet conveyed using a sheet center as a reference, the skew feed correcting device comprising:

a first conveying guide supporting one side edge portion of the sheet;

aligning means provided in the first conveying guide and having an abutment portion against which a side edge portion of the sheet is brought into abutment and a first rotary roller pair which conveys the sheet to abut the abutment portion;

contact-separation means which causes the first rotary roller pair to effect separation or contact;

a second conveying guide supporting the other side edge portion of the sheet;

positioning means for moving the first conveying guide in a direction substantially perpendicular to a sheet conveying direction;

a second rotary roller pair arranged on a downstream side of the first conveying guide and the second conveying guide with respect to the sheet conveying direction;

slide means for moving the second rotary roller pair in a direction substantially perpendicular to the sheet conveying direction; and sheet detecting means arranged in the vicinity of the second rotary roller pair, wherein, when conveying the sheet, the positioning means moves the first conveying guide such that the abutment portion is located at a predetermined distance from the side edge portion of the sheet that is conveyed normally by using the center thereof as a reference, the sheet is conveyed while aligned by being caused to abut the abutment portion by the first rotary roller pair, the first rotary roller pair is separated by the contact-separation means based on detection of the sheet by the sheet detecting means, and the second rotary roller pair is moved by the slide means so as to return the sheet at the predetermined distance.

2. A sheet conveying apparatus according to claim 1, wherein when sheets conveyed in succession differ in size, after the sheet detecting means detects a trailing edge of a preceding sheet, the contact-separation means causes the first rotary roller pair to effect contact before a leading edge of the succeeding sheet reaches the first rotary roller pair, and the positioning means moves the first conveying guide to situate the abutment portion at the predetermined distance from the side edge portion of the sheet.

3. A sheet conveying apparatus according to claim 1, wherein the first rotary roller pair comprises diagonal feed rollers whose rotating surfaces are inclined toward the abutment portion.

4. A sheet conveying apparatus according to claim 1, wherein the slide means comprises one selected from the group including: a timing belt and a motor; a rack and a pinion; and a ball screw.

5. A sheet conveying apparatus according to claim 1, wherein the positioning means comprises one selected from the group including: a timing belt and a motor; a rack and a pinion; and a ball screw.

6. A sheet conveying apparatus according to claim 1, wherein the secondary roller pair is a registration roller pair arranged on an upstream side of a transfer means of an image forming apparatus, the registration roller pair rotating at a speed higher than a transfer speed when the sheet is conveyed to the registration roller pair, and, from upon detection of the leading edge of the sheet by the sheet detecting means, reduced in speed to the transfer speed in synchronism with an image transferred by the transfer means.

7. A sheet conveying apparatus according to claim 6, wherein the sheet detecting means is an optical sensor, wherein driving means for driving the second rotary roller pair is a stepping motor, and wherein, when a sampling frequency of the optical sensor is f1 (Hz), and a driving frequency of the stepping motor is f2 (Hz), a relation of f1>f2 is satisfied.

8. An image forming apparatus comprising:

a sheet conveying apparatus as recited in any one of claims 1 through 7; and image forming means for forming an image on a sheet conveyed by the sheet conveying apparatus.

* * * * *

UNITED STATES PATENT AND TRADEMARK OFFICE

CERTIFICATE OF CORRECTION

PATENT NO. : 7,306,221 B2
APPLICATION NO. : 11/113024
DATED : December 11, 2007
INVENTOR(S) : Agata It is certified that error appears in the above-identified patent and that said Letters Patent is hereby corrected as shown below:

ON THE TITLE PAGE:
At Item (57), Abstract, Line 16, "abutted" should read --being abutted--.

COLUMN 16:
Line 47, "from" should be deleted.
Line 49, "reduced" should read --reducing--.

Signed and Sealed this

Twenty-second Day of July, 2008

JON W. DUDAS
*Director of the United States Patent and Trademark Office*